US012516877B2

(12) United States Patent
Zhao et al.

(10) Patent No.: US 12,516,877 B2
(45) Date of Patent: Jan. 6, 2026

(54) METHOD OF HYDROGEN LIQUEFACTION USING OPTIMIZED CLAUDE REFRIGERATION CYCLES

(71) Applicant: Evergreen Cryogenics Inc., Katy, TX (US)

(72) Inventors: James Zhao, Houston, TX (US); Shukui Zhao, Katy, TX (US)

(73) Assignee: Evergreen Cryogenics Inc., Katy, TX (US)

( * ) Notice: Subject to any disclaimer, the term of this patent is extended or adjusted under 35 U.S.C. 154(b) by 263 days.

(21) Appl. No.: 18/210,740

(22) Filed: Jun. 16, 2023

(65) Prior Publication Data

US 2024/0418437 A1 Dec. 19, 2024

(51) Int. Cl.
*F25J 1/00* (2006.01)
*F25J 1/02* (2006.01)

(52) U.S. Cl.
CPC ..... *F25J 1/0208* (2013.01); *F25J 1/001* (2013.01); *F25J 1/0067* (2013.01); *F25J 1/0072* (2013.01); *F25J 2205/60* (2013.01); *F25J 2205/82* (2013.01); *F25J 2210/04* (2013.01); *F25J 2215/04* (2013.01); *F25J 2215/10* (2013.01); *F25J 2220/02* (2013.01); *F25J 2230/24* (2013.01); *F25J 2230/30* (2013.01); *F25J 2230/42* (2013.01); *F25J 2240/12* (2013.01); *F25J 2245/90* (2013.01); *F25J 2270/14* (2013.01); *F25J 2270/20* (2013.01)

(58) Field of Classification Search
CPC .. F25J 1/001; F25J 1/005; F25J 1/0052; F25J 1/0067; F25J 1/0072; F25J 1/0208; F25J 1/0259; F25J 1/0279; F25J 1/0288; F25J 2205/60; F25J 2210/04; F25J 2215/00; F25J 2215/04; F25J 2230/20; F25J 2230/30; F25J 2245/90; F25J 2270/06; F25J 2270/14; F25J 2270/16; F25J 2270/20
See application file for complete search history.

(56) References Cited

U.S. PATENT DOCUMENTS

| | | | | |
|---|---|---|---|---|
| 12,287,144 | B2 * | 4/2025 | Heyrman | F25J 1/0065 |
| 2023/0366620 | A1 * | 11/2023 | Ducote, Jr. | F25J 1/004 |
| 2023/0392859 | A1 * | 12/2023 | Knoche | F25J 1/0072 |
| 2024/0361071 | A1 * | 10/2024 | Odell | F25J 1/0208 |

* cited by examiner

*Primary Examiner* — Keith M Raymond
(74) *Attorney, Agent, or Firm* — Eric M. Adams

(57) ABSTRACT

Methods and systems providing a process for cooling and liquefying a purified gaseous hydrogen feed stream to a liquid hydrogen stream that may be stored in a liquid hydrogen storage tank, as well as a system wherein ortho-hydrogen (o-H2) contained in the purified gaseous hydrogen feed stream may be converted to para-hydrogen (p-H2) through serial low-temperature catalytic converters along the cooling process from normal ambient temperature (300K) to the liquefied temperature about (20K) of the hydrogen.

20 Claims, 2 Drawing Sheets

METHOD OF HYDROGEN LIQUEFACTION USING OPTIMIZED CLAUDE REFRIGERATION CYCLES

BACKGROUND

1. Field of Inventions

The field of this application and any resulting patent is processes and systems for hydrogen liquefaction.

2. Description of Related Art

Various processes and systems have been proposed and utilized for hydrogen liquefaction, including some of the processes and systems disclosed in the references appearing on the face of this patent. However, those processes and systems lack all the steps or features of the processes and systems covered by any patent claims below. As will be apparent to a person of ordinary skill in the art, any processes and systems covered by claims of the issued patent solve many of the problems that prior art processes and systems have failed to solve. Also, the processes and systems covered by at least some of the claims of this patent have benefits that could be surprising and unexpected to a person of ordinary skill in the art based on the prior art existing at the time of invention.

SUMMARY

One or more specific embodiments disclosed herein includes a hydrogen liquefaction method, comprising the following steps: providing a purified gaseous hydrogen feed stream, wherein the purified gaseous hydrogen feed stream comprises about 75% ortho-hydrogen and 25% para-hydrogen, and further wherein the purified gaseous hydrogen feed stream comprises a pressure within the range of 800 kPa·G to 4,000 kPa·G and a temperature of about 300K; combining the purified gaseous hydrogen feed stream and a mixed intermediate-pressure circulation gaseous hydrogen stream inside a second hydrogen circulation compressor forming a second hydrogen circulation compressor final stage discharge stream, wherein the second hydrogen circulation compressor final stage discharge stream comprises a higher pressure within the range of 3200 kPa·G to 4000 kPa·G; splitting the second hydrogen circulation compressor final stage discharge stream into a first split gaseous hydrogen stream and a second split gaseous hydrogen stream; cooling the first split gaseous hydrogen stream to about 82K inside a precooling main heat exchanger to form a first cold gaseous hydrogen stream; purifying the first cold gaseous hydrogen stream inside a swing hydrogen absorption bed system to form a deep purified cold gaseous hydrogen stream; passing the deep purified cold gaseous hydrogen stream through a fixed-bed catalyst ortho-para hydrogen converter, wherein the deep purified cold gaseous hydrogen stream forms a first p-H2 enriched gaseous hydrogen stream, wherein the first p-H2 enriched gaseous hydrogen stream comprises a new equilibrium composition of about 53% ortho-hydrogen and about 47% para-hydrogen, and further wherein the first p-H2 enriched gaseous hydrogen stream increases in temperature due to the exothermic process of the ortho to para hydrogen conversion; cooling the first p-H2 enriched gaseous hydrogen stream inside the precooling main heat exchanger to form a first cold p-H2 enriched gaseous hydrogen stream, wherein the temperature of the first cold p-H2 enriched gaseous hydrogen stream is reduced to 82K; cooling the first cold p-H2 enriched gaseous hydrogen stream inside a catalyst filled intermediate-temperature ortho-para hydrogen converter of an intermediate temperature main heat exchanger to form a second cold p-H2 enriched gaseous hydrogen stream, wherein the second cold p-H2 enriched gaseous hydrogen stream comprises a temperature of about 40K; converting ortho-hydrogen to para-hydrogen in the second cold p-H2 enriched gaseous hydrogen stream inside the catalyst filled intermediate-temperature ortho-para hydrogen converter of the intermediate temperature main heat exchanger, wherein the second cold p-H2 enriched gaseous hydrogen stream comprises a new equilibrium composition of about 11% ortho-hydrogen and about 89% para-hydrogen; cooling the second cold p-H2 enriched gaseous hydrogen stream inside a catalyst filled low-temperature ortho-para hydrogen converter of a cold temperature main heat exchanger to form a subcooled high-pressure p-H2 enriched liquid hydrogen stream, wherein the subcooled high-pressure p-H2 enriched liquid hydrogen stream comprises a temperature of about 23.5K; converting ortho-hydrogen to para-hydrogen in the subcooled high-pressure p-H2 enriched liquid hydrogen stream inside the catalyst filled low-temperature ortho-para hydrogen converter of the cold temperature main heat exchanger, wherein the subcooled high-pressure p-H2 enriched liquid hydrogen stream comprises a new equilibrium composition of about 1% ortho-hydrogen and about 89% para-hydrogen; reducing the pressure of the subcooled high-pressure p-H2 enriched liquid hydrogen stream with a J/T valve to form a low-pressure liquid hydrogen product stream, wherein the low-pressure liquid hydrogen product stream comprises a pressure of about 50 kPa·G and temperature of about 21.7K; feeding the low-pressure liquid hydrogen product stream into a liquid hydrogen storage tank; removing a flashed gaseous hydrogen stream from the liquid hydrogen storage tank through a pressure control valve; feeding the flashed gaseous hydrogen stream into a hydrogen pressure let-down valve, wherein the flashed gaseous hydrogen stream exits the hydrogen pressure let-down valve as an optimized hydrogen Claude cycle hydrogen makeup stream; and sending the optimized hydrogen Claude cycle hydrogen makeup stream to an optimized hydrogen Claude half-opened cycle system, wherein the optimized hydrogen Claude cycle hydrogen makeup stream mixes with a low-pressure thermosiphon hydrogen vapor stream to form a mixed first hydrogen thermosiphon vapor stream.

DETAILED DESCRIPTION

1. Introduction

Figure 1:
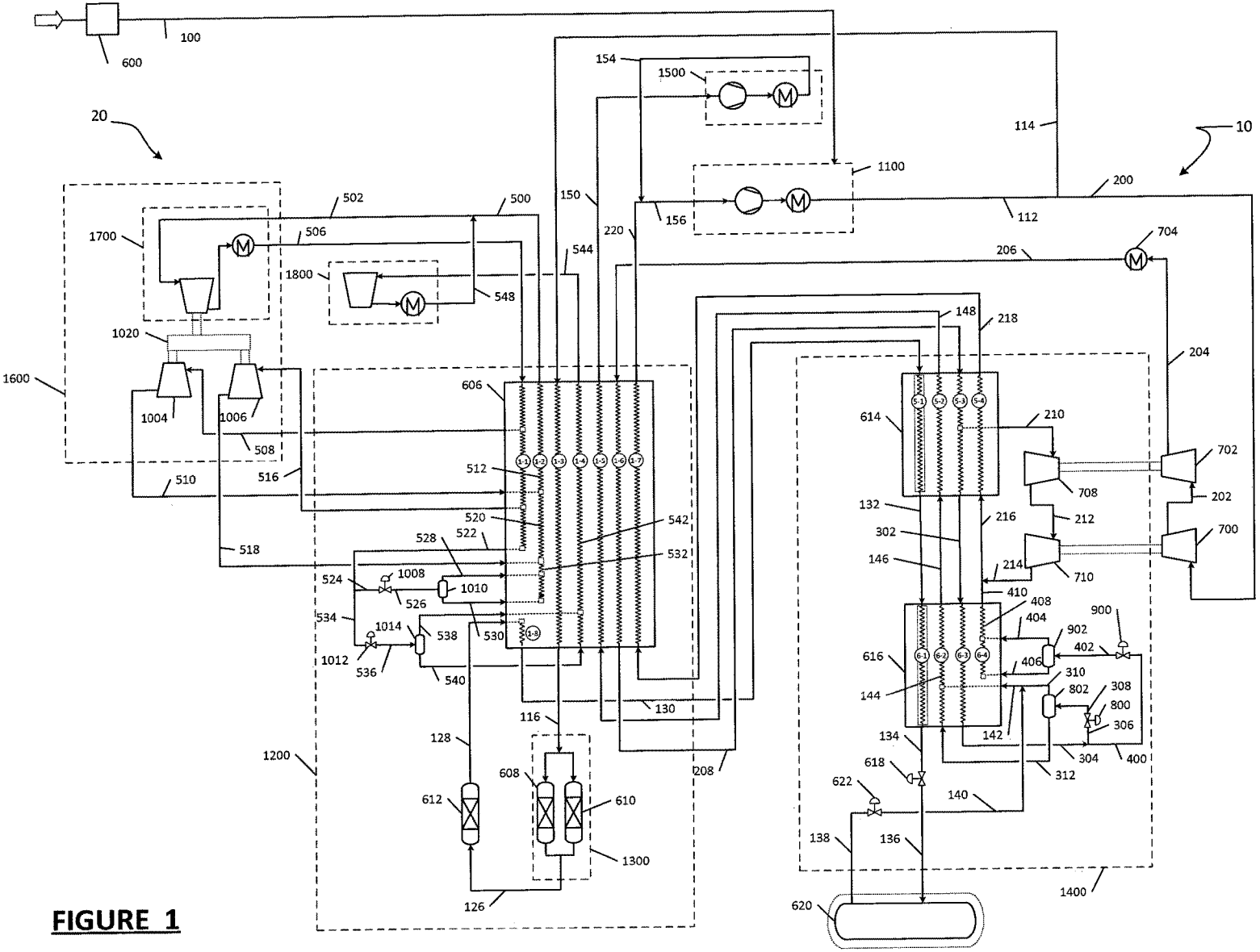
FIG. 1 shows an embodiment of a system for hydrogen liquefaction.

A detailed description will now be provided. The purpose of this detailed description, which includes the drawings, is to satisfy the statutory requirements of 35 U.S.C. § 112. For example, the detailed description includes a description of the inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details of the systems, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein may be defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in any printed publication, dictionary, or issued patent.

2. Certain Specific Embodiments

Now, certain specific embodiments are described, which are by no means an exclusive description of the inventions. Other specific embodiments, including those referenced in the drawings, are encompassed by this application and any patent that issues therefrom.

One or more specific embodiments disclosed herein includes a hydrogen liquefaction method, comprising the following steps: providing a purified gaseous hydrogen feed stream, wherein the purified gaseous hydrogen feed stream comprises about 75% ortho-hydrogen and 25% para-hydrogen, and further wherein the purified gaseous hydrogen feed stream comprises a pressure within the range of 800 kPa·G to 4,000 kPa·G and a temperature of about 300K; combining the purified gaseous hydrogen feed stream and a mixed intermediate-pressure circulation gaseous hydrogen stream inside a second hydrogen circulation compressor forming a second hydrogen circulation compressor final stage discharge stream, wherein the second hydrogen circulation compressor final stage discharge stream comprises a higher pressure within the range of 3200 kPa·G to 4000 kPa·G; splitting the second hydrogen circulation compressor final stage discharge stream into a first split gaseous hydrogen stream and a second split gaseous hydrogen stream; cooling the first split gaseous hydrogen stream to about 82K inside a precooling main heat exchanger to form a first cold gaseous hydrogen stream; purifying the first cold gaseous hydrogen stream inside a swing hydrogen absorption bed system to form a deep purified cold gaseous hydrogen stream; passing the deep purified cold gaseous hydrogen stream through a fixed-bed catalyst ortho-para hydrogen converter, wherein the deep purified cold gaseous hydrogen stream forms a first p-H2 enriched gaseous hydrogen stream, wherein the first p-H2 enriched gaseous hydrogen stream comprises a new equilibrium composition of about 53% ortho-hydrogen and about 47% para-hydrogen, and further wherein the first p-H2 enriched gaseous hydrogen stream increases in temperature due to the exothermic process of the ortho to para hydrogen conversion; cooling the first p-H2 enriched gaseous hydrogen stream inside the precooling main heat exchanger to form a first cold p-H2 enriched gaseous hydrogen stream, wherein the temperature of the first cold p-H2 enriched gaseous hydrogen stream is reduced to 82K; cooling the first cold p-H2 enriched gaseous hydrogen stream inside a catalyst filled intermediate-temperature ortho-para hydrogen converter of an intermediate temperature main heat exchanger to form a second cold p-H2 enriched gaseous hydrogen stream, wherein the second cold p-H2 enriched gaseous hydrogen stream comprises a temperature of about 40K; converting ortho-hydrogen to para-hydrogen in the second cold p-H2 enriched gaseous hydrogen stream inside the catalyst filled intermediate-temperature ortho-para hydrogen converter of the intermediate temperature main heat exchanger, wherein the second cold p-H2 enriched gaseous hydrogen stream comprises a new equilibrium composition of about 11% ortho-hydrogen and about 89% para-hydrogen; cooling the second cold p-H2 enriched gaseous hydrogen stream inside a catalyst filled low-temperature ortho-para hydrogen converter of a cold temperature main heat exchanger to form a subcooled high-pressure p-H2 enriched liquid hydrogen stream, wherein the subcooled high-pressure p-H2 enriched liquid hydrogen stream comprises a temperature of about 23.5K; converting ortho-hydrogen to para-hydrogen in the subcooled high-pressure p-H2 enriched liquid hydrogen stream inside the catalyst filled low-temperature ortho-para hydrogen converter of the cold temperature main heat exchanger, wherein the subcooled high-pressure p-H2 enriched liquid hydrogen stream comprises a new equilibrium composition of about 1% ortho-hydrogen and about 89% para-hydrogen; reducing the pressure of the subcooled high-pressure p-H2 enriched liquid hydrogen stream with a J/T valve to form a low-pressure liquid hydrogen product stream, wherein the low-pressure liquid hydrogen product stream comprises a pressure of about 50 kPa·G and temperature of about 21.7K; feeding the low-pressure liquid hydrogen product stream into a liquid hydrogen storage tank; removing a flashed gaseous hydrogen stream from the liquid hydrogen storage tank through a pressure control valve; feeding the flashed gaseous hydrogen stream into a hydrogen pressure let-down valve, wherein the flashed gaseous hydrogen stream exits the hydrogen pressure let-down valve as an optimized hydrogen Claude cycle hydrogen makeup stream; and sending the optimized hydrogen Claude cycle hydrogen makeup stream to an optimized hydrogen Claude half-opened cycle system, wherein the optimized hydrogen Claude cycle hydrogen makeup stream mixes with a low-pressure thermosiphon hydrogen vapor stream to form a mixed first hydrogen thermosiphon vapor stream.

In any one of the processes or systems disclosed herein, the precooling main heat exchanger may comprise a plate-fin brazed aluminum type heat exchanger.

In any one of the processes or systems disclosed herein, the intermediate temperature main heat exchanger may comprise a plate-fin brazed aluminum type heat exchanger.

In any one of the processes or systems disclosed herein, the cold temperature main heat exchanger may comprise a plate-fin brazed aluminum type heat exchanger.

In any one of the processes or systems disclosed herein, the hydrogen liquefaction method may further comprise the following steps: providing a high-pressure circulation nitrogen stream, wherein the high-pressure circulation nitrogen stream comprises a pressure of about 4,425 kPa·G and a temperature of about 313K; cooling the high-pressure circulation nitrogen stream inside the precooling main heat exchanger; splitting the high-pressure circulation nitrogen stream into the following three streams: a warm nitrogen turbo-expander feed stream, wherein the warm nitrogen turbo-expander feed stream comprises a temperature of about 286K; a cold nitrogen turbo-expander feed stream, wherein the cold nitrogen turbo-expander feed stream comprises a temperature of about 174K; and a subcooled high-pressure circulation liquid nitrogen stream, wherein the subcooled high-pressure circulation liquid nitrogen stream comprises a temperature of about 111K; splitting the subcooled high-pressure circulation liquid nitrogen stream into a first subcooled high-pressure circulation liquid nitrogen stream and a second subcooled high-pressure circulation liquid nitrogen stream; feeding the first subcooled high-pressure circulation liquid nitrogen stream into a first circulation liquid nitrogen pressure let-down valve, wherein the pressure of the first subcooled high-pressure circulation liquid nitrogen stream is reduced to about 40 kPa·G, and further wherein the temperature of the first subcooled high-pressure circulation liquid nitrogen stream is reduced to about 80.3K; introducing a low-pressure cold circulation nitrogen stream from the first circulation liquid nitrogen pressure let-down valve into a low-pressure nitrogen thermosiphon vessel, wherein the low-pressure cold circulation nitrogen stream is separated into a low-pressure thermosiphon nitrogen liquid stream and a low-pressure thermosiphon nitrogen vapor stream; introducing the low-pressure thermosiphon nitrogen liquid stream into the precooling main heat exchanger; vaporizing the low-pressure thermosiphon nitrogen liquid stream inside the precooling main heat exchanger; mixing the totally vaporized low-pressure thermosiphon nitrogen liquid stream with the low-pressure thermosiphon nitrogen vapor stream in the precooling main heat exchanger to form a low-pressure thermosiphon nitrogen mixed stream; warming the low-pressure thermosiphon nitrogen mixed stream in the precooling main heat exchanger; flowing the warmed low-pressure thermosiphon nitrogen mixed stream out of the precooling main heat exchanger as a low-pressure circulation gaseous nitrogen stream, wherein the low-pressure circulation gaseous nitrogen stream is employed as a feed stream for a first nitrogen circulation compressor; compressing the low-pressure circulation gaseous nitrogen stream inside the first nitrogen circulation compressor to a pressure about 525 kPa·G to form a first nitrogen circulation compressor discharge stream; commingling the first nitrogen circulation compressor discharge stream from the first nitrogen circulation compressor with an intermediate-pressure circulation gaseous nitrogen stream to form a mixed intermediate-pressure circulation gaseous nitrogen stream; flowing the second subcooled high-pressure circulation liquid nitrogen stream to a second circulation liquid nitrogen pressure let-down valve, wherein the pressure of the second subcooled high-pressure circulation liquid nitrogen stream is reduced to about 565 kPa·G, and further wherein the temperature of the second subcooled high-pressure circulation liquid nitrogen stream is reduced to about 98K; removing an intermediate-pressure cold circulation nitrogen stream from the second circulation liquid nitrogen pressure let-down valve; introducing the intermediate-pressure cold circulation nitrogen stream to an intermediate-pressure nitrogen thermosiphon vessel, wherein the intermediate-pressure cold circulation nitrogen stream is separated into an intermediate-pressure thermosiphon nitrogen liquid stream and an intermediate-pressure thermosiphon nitrogen vapor stream; introducing the intermediate-pressure thermosiphon nitrogen liquid stream into the precooling main heat exchanger; vaporizing the intermediate-pressure thermosiphon nitrogen liquid stream in the precooling main heat exchanger; mixing the totally vaporized intermediate-pressure thermosiphon nitrogen liquid stream with the intermediate-pressure thermosiphon nitrogen vapor stream in the precooling main heat exchanger to form an intermediate-pressure thermosiphon nitrogen mixed stream; warming the intermediate-pressure thermosiphon nitrogen mixed stream in the precooling main heat exchanger; mixing the intermediate-pressure thermosiphon nitrogen mixed stream with a cold nitrogen turbo-expander discharge stream to form a first nitrogen mixed stream, wherein the first nitrogen mixed stream comprises a temperature of about 105K; warming the first nitrogen mixed stream in the precooling main heat exchanger; mixing the first nitrogen mixed stream with a warm nitrogen turbo-expander discharge stream to form a second nitrogen mixed stream, wherein the combined second nitrogen mixed stream comprises a temperature of about 180K; warming the second nitrogen mixed stream in the precooling main heat exchanger to a temperature of about 311K; flowing the second nitrogen mixed stream out of the precooling main heat exchanger as the intermediate-pressure circulation gaseous nitrogen stream; expanding the high-pressure warm nitrogen turbo-expander feed stream in a warm nitrogen turbo-expander to form the warm nitrogen turbo-expander discharge stream, wherein the warm nitrogen turbo-expander discharge stream comprises a lower pressure of about 543 kPa·G and a temperature of about 180K; expanding the high-pressure cold nitrogen turbo-expander feed stream in a cold nitrogen turbo-expander to form the cold nitrogen turbo-expander discharge stream, wherein the cold nitrogen turbo-expander discharge stream comprises a lower pressure of about 560 kPa·G and a temperature of about 105K; and compressing the mixed intermediate-pressure circulation gaseous nitrogen stream in a second nitrogen circulation compressor to the high-pressure circulation nitrogen stream, wherein the high-pressure circulation nitrogen stream comprises a pressure of about 4425 kPa·G.

In any one of the processes or systems disclosed herein, the method may further comprise a warm temperature coldbox, wherein the warm temperature coldbox comprises perlites, and further wherein the warm temperature coldbox comprises the precooling main heat exchanger, a first hydrogen purification absorption bed, a second hydrogen purification absorption bed, the fixed-bed catalyst ortho-para hydrogen converter, the first circulation liquid nitrogen pressure let-down valve, the low-pressure nitrogen thermosiphon vessel, the second circulation liquid nitrogen pressure let-down valve, and the intermediate-pressure nitrogen thermosiphon vessel.

In any one of the processes or systems disclosed herein, the first nitrogen circulation compressor may comprise a multistage compressor with a cooler on each stage discharge.

In any one of the processes or systems disclosed herein, the first nitrogen circulation compressor may comprise a two-stage oil-free reciprocating compressor.

In any one of the processes or systems disclosed herein, the first nitrogen circulation compressor may comprise a three-stage oil-free reciprocating compressor.

In any one of the processes or systems disclosed herein, the second nitrogen circulation compressor may comprise a multistage compressor with a cooler on each stage discharge.

In any one of the processes or systems disclosed herein, the second nitrogen circulation compressor may comprise a four-stage integrally-geared type centrifugal compressor.

In any one of the processes or systems disclosed herein, the four-stage integrally-geared type centrifugal compressor may be integrated with the warm nitrogen turbo expander and the cold nitrogen turbo-expander to form an integrated nitrogen compander.

In any one of the processes or systems disclosed herein, the warm nitrogen turbo-expander and the cold nitrogen turbo-expander may be arranged in parallel with about the same expansion pressure ratio in range of 7 to 8.

In any one of the processes or systems disclosed herein, the first nitrogen circulation compressor may be combined with the integrated nitrogen compander on a common integral-gear.

In any one of the processes or systems disclosed herein, the hydrogen liquefaction method may further comprise the following steps: providing a high-pressure circulation hydrogen stream, wherein the high-pressure circulation hydrogen stream comprises a pressure within the range of about 3,500 kPa·G to 4,400 kPa·G and a temperature of about 313K; cooling the high-pressure circulation hydrogen stream in the precooling main heat exchanger to form a first cold high-pressure circulation hydrogen stream, wherein the first cold high-pressure circulation hydrogen stream comprises a temperature of about 82K; further cooling the first cold high-pressure circulation hydrogen stream in the intermediate temperature main heat exchanger; withdrawing a first hydrogen turbo-expander feed stream from the further cooled first cold high-pressure circulation hydrogen stream, wherein the first hydrogen turbo-expander feed stream comprises a temperature within the range of 61K to 65K, and further wherein the remaining further cooled first cold high-pressure circulation hydrogen stream is further cooled to a temperature of about 40K; removing a second cold high-pressure circulation hydrogen stream from the intermediate temperature main heat exchanger; cooling the second cold high-pressure circulation hydrogen stream in the cold temperature main heat exchanger to form a subcooled high-pressure circulation liquid hydrogen stream, wherein the subcooled high-pressure circulation liquid hydrogen stream comprises a temperature of about 32K; splitting the subcooled high-pressure circulation liquid hydrogen stream into a first subcooled high-pressure circulation liquid hydrogen stream and a second subcooled high-pressure circulation liquid hydrogen stream; reducing the pressure of the first subcooled high-pressure circulation liquid hydrogen stream in a first circulation liquid hydrogen pressure let-down valve to about 50 kPa·G forming a low-pressure cold circulation hydrogen stream, wherein the low-pressure cold circulation hydrogen stream comprises a temperature of about 21.7K, and further wherein the low-pressure cold circulation hydrogen stream comprises vapor flash-out; separating the low-pressure cold circulation hydrogen stream in a low-pressure hydrogen thermosiphon vessel into a low-pressure thermosiphon hydrogen vapor stream and a low-pressure thermosiphon hydrogen liquid stream; vaporizing the low-pressure thermosiphon hydrogen liquid in the cold temperature main heat exchanger; mixing the totally vaporized low-pressure thermosiphon hydrogen liquid with the mixed first hydrogen thermosiphon vapor stream to form a mixed low-pressure thermosiphon hydrogen stream; warming the mixed low-pressure thermosiphon hydrogen stream to form a cold low-pressure circulation gaseous hydrogen stream, wherein the cold low-pressure circulation gaseous hydrogen stream comprises a temperature of about 38.5K; further warming the cold low-pressure circulation gaseous hydrogen stream in the intermediate temperature main heat exchanger to form an intermediate temperature low-pressure circulation gaseous hydrogen stream, wherein the intermediate temperature low-pressure circulation gaseous hydrogen stream comprises a temperature of about 80.3K; further warming the intermediate temperature low-pressure circulation gaseous hydrogen stream in the precooling main heat exchanger to form a low-pressure circulation gaseous hydrogen stream, wherein the low-pressure circulation gaseous hydrogen stream comprises a temperature of about 311K; compressing the low-pressure circulation gaseous hydrogen stream in the first hydrogen circulation compressor to form a first hydrogen circulation compressor discharge stream, wherein the first hydrogen circulation compressor discharge stream comprises a pressure of 790 kPa·G; commingling the compressed first hydrogen circulation compressor discharge stream with an intermediate-pressure circulation gaseous hydrogen stream to form a mixed intermediate-pressure circulation gaseous hydrogen stream; reducing the pressure of the second subcooled high-pressure circulation liquid hydrogen stream in a second circulation liquid hydrogen pressure let-down valve to form an intermediate-pressure cold circulation hydrogen stream, wherein the intermediate-pressure cold circulation hydrogen stream comprises a pressure of about 815 kPa·G and a temperature of about 30.7K, and further wherein the intermediate-pressure cold circulation hydrogen stream comprises vapor flash-out; separating the intermediate-pressure cold circulation hydrogen stream in an intermediate-pressure hydrogen thermosiphon vessel into an intermediate-pressure thermosiphon hydrogen liquid stream and an intermediate-pressure thermosiphon hydrogen vapor stream; vaporizing the intermediate-pressure thermosiphon hydrogen liquid stream in the cold temperature main heat exchanger; mixing the totally vaporized intermediate-pressure thermosiphon hydrogen liquid stream with the second hydrogen thermosiphon vapor stream to form a mixed hydrogen vapor stream; further warming the mixed hydrogen vapor stream in the cold temperature main heat exchanger to form a first cold intermediate-pressure circulation gaseous hydrogen stream, wherein the cold intermediate-pressure circulation gaseous hydrogen stream comprises a temperature of about 38.5K; mixing the first cold intermediate-pressure circulation gaseous hydrogen stream with the second hydrogen turbo-expander discharge stream to form a second cold intermediate-pressure circulation gaseous hydrogen stream; warming the second cold intermediate-pressure circulation gaseous hydrogen stream in the intermediate temperature main heat exchanger to form an intermediate temperature intermediate-pressure circulation gaseous hydrogen stream, wherein the intermediate temperature intermediate-pressure circulation gaseous hydrogen stream comprises a temperature of about 80.3K; further warming the intermediate temperature intermediate-pressure circulation gaseous hydrogen stream in the precooling main heat exchanger to form an intermediate-pressure circulation gaseous hydrogen stream, wherein the intermediate-pressure circulation gaseous hydrogen stream comprises a temperature of about 311K; expanding a high-pressure first hydrogen turbo-expander feed stream in a first hydrogen turbo-expander to form a lower pressure as a lower pressure first hydrogen turbo-expander discharge stream; further expanding the lower pressure first hydrogen turbo-expander discharge stream in a second hydrogen turbo-expander to form a second hydrogen turbo-expander discharge stream, wherein the second hydrogen turbo-expander discharge stream comprises a pressure of about 805 kPa·G and a temperature of about 38K; compressing the second split gaseous hydrogen stream in a second hydrogen exp-compressor to form a higher pressure as a second hydrogen exp-compressor discharge stream; further compressing the second hydrogen exp-compressor discharge stream in a first hydrogen exp-compressor to form a first hydrogen exp-compressor discharge stream, wherein the first hydrogen exp-compressor discharge stream comprises a pressure in the range of about 3,500 kPa·G to 4,400 kPa·G; and cooling the first hydrogen exp-compressor discharge stream in an exp-compressor discharge cooler to form the high-pressure circulation hydrogen stream, wherein the high-pressure circulation hydrogen stream comprises a temperature of about 313K.

In any one of the processes or systems disclosed herein, the first hydrogen exp-compressor may be driven by the first hydrogen turbo-expander to form a first expander set, and the second hydrogen exp-compressor may be driven by the second hydrogen turbo-expander to form a second expander set.

In any one of the processes or systems disclosed herein, the first expander set and the second expander set may be arranged in serial connection.

In any one of the processes or systems disclosed herein, the first expander set and the second expander set may be magnetic bearing type sets.

In any one of the processes or systems disclosed herein, the first hydrogen circulation compressor and the second hydrogen circulation compressor may be integrated by a common crank shaft to form an integrated hydrogen circulation compressor.

In any one of the processes or systems disclosed herein, wherein the system may further comprise a cold temperature coldbox, wherein the cold temperature coldbox comprises a multilayer insulation vacuum, and further wherein the cold temperature coldbox comprises product liquid hydrogen pressure let-down valve, the liquid hydrogen storage tank pressure control valve, the first circulation liquid hydrogen pressure let-down valve, the low-pressure hydrogen thermosiphon vessel, the second circulation liquid hydrogen pressure let-down valve, the intermediate-pressure hydrogen thermosiphon vessel, the first hydrogen turbo-expander, the second hydrogen turbo-expander, the intermediate temperature main heat exchanger, and the cold temperature main heat exchanger.

3. Specific Embodiments in the Figures

The drawings presented herein are for illustrative purposes only and are not intended to limit the scope of the claims. Rather, the drawings are intended to help enable one having ordinary skill in the art to make and use the claimed inventions.

Hydrogen is emerging as one of the most promising energy carriers for decarbonization of the global energy system. Liquid hydrogen is widely considered to be critical to hydrogen's large-scale adoption regarding transportation and storage. The liquefaction and storage processes must, however, be safe and efficient for liquid hydrogen to be viable for the hydrogen industry.

Hydrogen liquefaction technology is known to be one of the most energy-intensive industrial processes that requires specially designed equipment, expensive components, and high operation costs. Currently, the most widely used hydrogen liquefaction process is a closed hydrogen Claude loop refrigeration system with liquid nitrogen precooling by evaporation of a liquid nitrogen stream at typically 78 Kelvin (K) to precool the hydrogen feed to about 80K. The liquefiers using this process can provide specific power consumption of 11-13 kWh/kg-LH2, which is approximately 30% to 40% of the hydrogen fuel's energy content. Even though using mixed refrigerant (a hydrocarbon mixture) for precooling to reduce the overall energy consumption for hydrogen liquefaction has been studied by the industry, it has not been adopted since it uses environmentally unfriendly refrigerants, hydrocarbons.

Identifying and designing an improved liquefaction process is therefore crucial, including considering a range of interconnected parameters from energy consumption, appropriate equipment selections, environmentally friendly refrigerant selections, to unique liquid-hydrogen physics in the form of ortho-para hydrogen conversion.

At normal ambient 300K conditions, gaseous hydrogen contains about 75% of ortho-hydrogen (o-H2) and 25% of para-hydrogen (p-H2). If this gaseous hydrogen is cooled and liquefied at 20K, such o-H2 and p-H2 proportions will be preserved in the liquid hydrogen. Further, the o-H2 form is unstable at low temperature 20K, and it will eventually form p-H2. Since the formation of p-H2 from o-H2 is an exothermic process, it will therefore cause vaporization of hydrogen during its storage and transportation. Therefore, it is important to simultaneously convert o-H2 to p-H2 during the cooling and liquefying process to make the liquefied hydrogen stream have greater than 95% p-H2 when it reaches the inlet of the storage tank.

Consequently, there is a need in the art for an optimized method and/or refrigeration system capable of producing liquefied hydrogen at a desired capacity using a minimum amount of equipment, improved refrigeration efficiency using environmentally friendly and easier sourced refrigerants nitrogen and hydrogen, and scalable design to reduce both Capex and Opex.

In embodiments, the methods and systems disclosed herein have predicated the following specific power consumption compared to the 11-13 kWh/kg-LH2 of the current hydrogen liquefiers using hydrogen Claude cycle with nitrogen precooling, as shown in the following Table 1:

TABLE 1

| Hydrogen Feed Gas Pressure (kPA.G) | 800 | 1500 | 2000 | 3200 | 4000 |
|---|---|---|---|---|---|
| Precative Specific Power Consumption (kWh/kg-LH2) | 9.1 | 8.9 | 8.7 | 8.6 | 8.3 |

Generally, embodiments of the methods and systems described herein provide a process for cooling and liquefying a purified gaseous hydrogen feed stream to a liquid hydrogen stream that may be stored in a liquid hydrogen storage tank, as well as a system wherein ortho-hydrogen (o-H2) contained in the purified gaseous hydrogen feed stream may be converted to para-hydrogen (p-H2) through serial low-temperature catalytic converters along the cooling process from normal ambient temperature (300K) to the liquefied temperature about (20K) of the hydrogen.

More particularly, in embodiments the purified gaseous hydrogen feed stream may comprise a pressure range of between 800 kPa·H to 4,000 kPa·G and a temperature range of between 288K to 300K, the normal ambient temperature.

Further, embodiments may comprise a method of liquefying hydrogen using two optimized Claude refrigeration cycles. For example, in embodiments a method of liquefying hydrogen may comprise one nitrogen Claude closed cycle for precooling and one hydrogen Claude half-opened cycle for hydrogen liquefaction.

Additionally, embodiments described herein may be employed to achieve greater than 15 tons per day of hydrogen liquefaction capacity with specific power consumption less than 9.5 kWh/kg-LH2.

Figure 2:
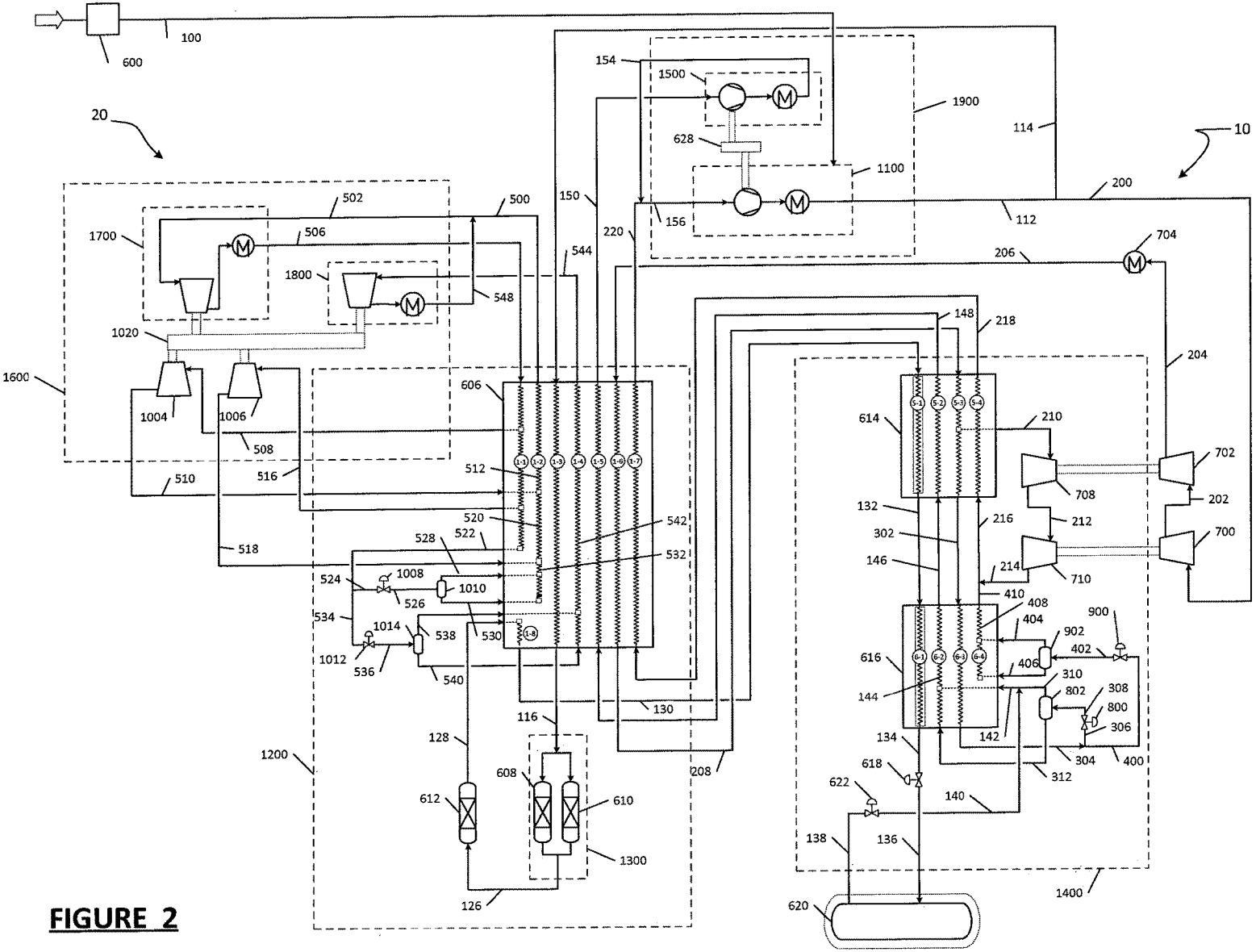
FIG. 2 shows an alternative embodiment of a system for hydrogen liquefaction.

Referring to FIGS. 1 and 2, a specific embodiment, e.g., version or example, of a system for hydrogen liquefaction is illustrated. These figures may show features which may be found in various specific embodiments, including the embodiments shown in this specification and those not shown.

FIG. 1 shows an embodiment of a system for hydrogen liquefaction. The following is a discussion of an embodiment shown in FIG. 1 for hydrogen precooling, ortho-para hydrogen conversion, and liquefaction.

In embodiments, a purified gaseous hydrogen feed stream 100 may exit a gaseous hydrogen feed pretreatment unit 600. In embodiments, the purified gaseous hydrogen feed stream 100 may comprise a pressure within the range of 800 kPa·G to 4,000 kPa·G and a temperature of about ambient 300K. Further, in embodiments, the purified gaseous hydrogen feed stream 100 may be supplied from a hydrogen electrolyzer system or other industry gas plants such as syngas plants, propane dehydrogenation (PDH) plants, etc., after purifying to 99.999% hydrogen purity. In embodiments, at ambient temperature of about 300K, the purified gaseous hydrogen feed stream 100 may contain about 75% of ortho-hydrogen (o-H2) and 25% of para-hydrogen (p-H2). In embodiments, the purified gaseous hydrogen feed stream 100 may enter a second hydrogen circulation compressor 1100.

In embodiments, the second hydrogen circulation compressor 1100 may comprise a multistage compressor with a cooler on each stage discharge (details not shown). In embodiments, the second hydrogen circulation compressor 1100 may comprise a two-stage or three-stage oil-free reciprocating compressor with a first stage suction pressure of about 780 kPa·G and a last stage discharge pressure of about 3,200 kPa·G when the purified gaseous hydrogen feed stream 100 comprises a pressure of about equal to or less than 3,200 kPa·G. In other embodiments, the second hydrogen circulation compressor 1100 may comprise a three-stage oil-free reciprocating compressor with a first stage suction pressure of about 780 kPa·G and a last stage discharge pressure of about 4,000 kPa·G when the purified gaseous hydrogen feed stream 100 comprises a pressure between the range 3,200 kPa·G to 4,000 kPa·G. In embodiments, the purified gaseous hydrogen feed stream 100 may either mix into any stage suction stream or the final stage discharge cooler outlet stream of the second hydrogen circulation compressor 1100, depending on the pressure of the purified gaseous hydrogen feed stream 100.

In embodiments, the mixed intermediate-pressure circulation gaseous hydrogen stream 156 may enter the first stage suction of the second hydrogen circulation compressor 1100. In embodiments, the pressure of the mixed intermediate-pressure circulation gaseous hydrogen stream 156 may be increased after mixing with the purified gaseous hydrogen feed stream 100 at any stage suction stream or final stage discharge stream. In embodiments, the second hydrogen circulation compressor final stage discharge stream 112 may exit the second hydrogen circulation compressor 1100. In embodiments, the second hydrogen circulation compressor final stage discharge stream 112 may comprise about 67% o-H2 and 33% p-H2 resulting from the mixing of the mixed intermediate-pressure circulation gaseous hydrogen stream 156, which may contain about 66% o-H2 and 34% p-H2, and the purified gaseous hydrogen feed stream 100, which may contain about 75% o-H2 and 25% p-H2.

In embodiments, the second hydrogen circulation compressor final stage discharge stream 112 may comprise a pressure within the range of 3,200 kPa·G to 4,000 kPa·G and a temperature of about 313K. In embodiments, the second hydrogen circulation compressor final stage discharge stream 112 may split into two streams. In embodiments, the second hydrogen circulation compressor final stage discharge stream 112 may split into a first split gaseous hydrogen stream 114 and a second split gaseous hydrogen stream 200. In embodiments, the first split gaseous hydrogen stream 114 may proceed to a pass 1-3 from the warm end of a precooling main heat exchanger 606, wherein the first split gaseous hydrogen stream 114 may exchange heat with cold passes 1-2, 1-4, 1-5 and 1-7. In embodiments, the first split gaseous hydrogen stream 114 may exit the precooling main heat exchanger 606 as a first cold gaseous hydrogen stream 116. In embodiments, the first cold gaseous hydrogen stream 116 may comprise a temperature of about 82K. In embodiments, the precooling main heat exchanger 606 may comprise a plate-fin brazed aluminum heat exchanger (BAHX) type.

In embodiments, the first cold gaseous hydrogen stream 116 may proceed to a swing hydrogen absorption bed unit 1300. In embodiments, the swing hydrogen absorption bed unit 1300 may comprise a first hydrogen purification absorption bed 608 and a second hydrogen purification absorption bed 610, as well as the regeneration piping connections (details not shown). In embodiments, the first cold gaseous hydrogen stream 116 may enter either the first hydrogen purification absorption bed 608 or the second hydrogen purification absorption bed 610. In embodiments, the first hydrogen purification absorption bed 608 or the second hydrogen purification absorption bed 610 may further purify the first cold gaseous hydrogen stream 116 by absorbing any contaminant components such as nitrogen, oxygen, carbon oxidize, etc., to meet the liquid hydrogen specifications when the first cold gaseous hydrogen split stream 116 exits either the first hydrogen purification absorption bed 608 or the second hydrogen purification bed 610. In embodiments, the first hydrogen purification absorption bed 608 and the second hydrogen purification absorption bed 610 may be configured as regenerable swing beds with one in absorption and the other one in regeneration (detail not shown). In embodiments, the first cold gaseous hydrogen stream 116 may exit the swing hydrogen absorption bed system 1300 to form a deep purified cold gaseous hydrogen stream 126.

In embodiments, the deep purified cold gaseous hydrogen stream 126 may exit from the swing hydrogen absorption bed unit 1300. In embodiments, the deep purified cold gaseous hydrogen stream 126 may flow to a fixed-bed catalyst ortho-para hydrogen converter 612. In embodiments, the deep purified cold gaseous hydrogen stream 126 may be brought to an equilibrium composition between the two spin isomers o-H2 and p-H2. In embodiments, this equilibrium may be obtained by passing the deep purified cold gaseous hydrogen stream 126 through the fixed-bed catalyst converter 612 that may catalyze the spontaneous and exothermic conversion of o-H2 to p-H2. In embodiments, it may be assumed that the fixed-bed catalyst converter 612 is sufficiently long to allow the new o-H2 and p-H2 equilibrium state to form. In embodiments, a first p-H2 enriched gaseous hydrogen stream 128 may exit the fixed-bed catalyst converter 612, wherein the first p-H2 enriched gaseous hydrogen stream 128 may comprise a new equilibrium of about 53% o-H2 and about 47% p-H2 with a temperature of about 89K due to the exothermic conversion process. In embodiments, the first p-H2 enriched gaseous hydrogen stream 128 may be routed back to pass 1-8 of the precooling main heat exchanger 606, wherein the first p-H2 enriched gaseous hydrogen stream 128 may be cooled down to a temperature of 82K. In embodiments, a first cold p-H2 enriched gaseous hydrogen stream 130 may exit pass 1-8 of the precooling main heat exchanger 606.

In embodiments, the first cold p-H2 enriched gaseous hydrogen stream 130 may comprise a pressure in the range of between 3,125 kPa·G to 3,925 kPa·G and a temperature of about 82K. In embodiments, the first cold p-H2 enriched gaseous hydrogen stream 130 may enter pass 5-1 from the warm end of an intermediate temperature main heat exchanger 614, wherein the first cold p-H2 enriched gaseous hydrogen stream 130 may exchange heat with cold stream passes 5-2 and 5-4 and may be cooled down to a temperature of about 40K. In embodiments, the first cold p-H2 enriched gaseous hydrogen stream 130 may exit the intermediate temperature main heat exchanger 614 as a second cold p-H2 enriched gaseous hydrogen stream 132. In embodiments, the outlet gaseous hydrogen stream 132 may also be brought to another equilibrium composition between the two spin isomers o-H2 and p-H2 by passing through the catalyst filled ortho-para hydrogen converter pass 5-1, wherein spontaneous and exothermic conversion of o-H2 to p-H2 occurs. In embodiments, it may be assumed that the catalyst in pass 5-1 is sufficiently long to allow the new o-H2 and pH2 equilibrium state to form. In embodiments, the second p-H2 enriched gaseous hydrogen stream 132 may reach about 11% o-H2 and about 89% p-H2 new equilibrium. In embodiments, the released heat due to the exothermic conversion of o-H2 to p-H2 in pass 5-1 may also be absorbed by the cold passes 5-2 and 5-4.

In embodiments, the intermediate temperature main heat exchanger 614 may comprise a plate-fin brazed aluminum heat exchanger (BAHX) type.

In embodiments, the second cold p-H2 enriched gaseous hydrogen stream 132 may comprise a pressure in the range of between 3,090 kPa·G to 3,890 kPa·G and a temperature of about 40K. In embodiments, the second cold p-H2 enriched gaseous hydrogen stream 132 may enter pass 6-1 from the warm end of a cold temperature main heat exchanger 616, wherein the second cold p-H2 enriched gaseous hydrogen stream 132 may exchange heat with the cold stream passes 6-2 and 6-4, and further wherein the temperature of the second cold p-H2 enriched gaseous hydrogen stream 132 may be reduced to about 23.5K, becoming subcooled liquid. In embodiments, the second cold p-H2 enriched gaseous hydrogen stream 132 may exit the cold temperature main heat exchanger 616 as a subcooled high-pressure p-H2 enriched liquid hydrogen stream 134. In embodiments, the subcooled high-pressure p-H2 enriched liquid hydrogen stream 134 may also be brought to another equilibrium composition between the two spin isomers o-H2 and p-H2 based on passing the catalyst filled ortho-para hydrogen pass 6-1, wherein spontaneous and exothermic conversion of o-H2 to p-H2 may occur. In embodiments, it may be assumed that the catalyst in pass 6-1 is sufficiently long to allow the new o-H2 and pH2 equilibrium state to form. In embodiments, the subcooled high-pressure p-H2 enriched liquid hydrogen stream 134 may reach less than 1% o-H2 and greater than 99% p-H2 new equilibrium. In embodiments, the released heat due to the exothermic conversion of o-H2 to p-H2 in pass 6-1 may be absorbed by the cold passes 6-2 and 6-4.

In embodiments, the cold temperature main heat exchanger 616 may typically be a plate-fin brazed aluminum heat exchanger (BAHX) type.

In embodiments, the subcooled high-pressure p-H2 enriched liquid hydrogen stream 134 may comprise a pressure in the range of 3,070 kPa·G to 3,870 kPa·G and a temperature of about 23.5K. In embodiments, the subcooled high-pressure p-H2 enriched liquid hydrogen stream 134 may enter a product liquid hydrogen pressure let-down valve 618. In embodiments, the product liquid hydrogen pressure let-down valve 618 may comprise a Joule-Thomson (J/T) valve, wherein the pressure of the subcooled high-pressure p-H2 enriched liquid hydrogen stream 134 may be reduced to about 50 kPa·G and the temperature of the subcooled high-pressure p-H2 enriched liquid hydrogen stream 134 may be reduced to about 21.7K. In embodiments, the subcooled high-pressure p-H2 enriched liquid hydrogen stream 134 may exit the product liquid hydrogen pressure let-down valve 618 as a low-pressure liquid hydrogen product 136. In embodiments, the low-pressure liquid hydrogen product 136 may comprise about 10% to 12% gaseous hydrogen flash-out due to the pressure reduction and may be routed to a liquid hydrogen storage tank 620. In embodiments, any liquid hydrogen with a p-H2 content greater than 99% may be stored in the liquid hydrogen storage tank 620. In embodiments, the liquid hydrogen stored in the liquid hydrogen storage tank 620 may be pumped to a liquid hydrogen transportation trailer (not shown) by a liquid hydrogen pump (not shown) to ship out as liquid hydrogen product.

Further, in embodiments, flashed gaseous hydrogen may be separated out of the low-pressure liquid hydrogen product 136 from the liquid hydrogen storage tank 620 as a flashed gaseous hydrogen stream 138. In embodiments, the pressure of the liquid hydrogen storage tank 620 may be regulated by a liquid hydrogen storage tank pressure control valve 622. In embodiments, the flashed gaseous hydrogen stream 138 may exit the hydrogen storage tank pressure control valve 622 as an optimized hydrogen Claude cycle hydrogen makeup stream 140. In embodiments, the optimized hydrogen Claude cycle hydrogen makeup stream 140 may enter an optimized hydrogen Claude half-opened cycle system 10, wherein the optimized hydrogen Claude cycle hydrogen makeup stream 140 may commingle with a low-pressure hydrogen thermosiphon vapor stream 310 to form a mixed first hydrogen thermosiphon vapor stream 142. In embodiments, the mass flow of the optimized hydrogen Claude cycle hydrogen makeup stream 140 may be eventually removed from the optimized hydrogen Claude half-opened cycle 10 by the first split gaseous hydrogen stream 114 to be liquefied, and therefore this is referred as a "half-opened" cycle.

In embodiments, an optimized nitrogen Claude closed cycle 20 starts with a high-pressure circulation nitrogen stream 506, wherein the high-pressure circulation nitrogen stream 506 may comprise a pressure of about 4,425 kPa·G and a temperature of about 313K. In embodiments, the optimized nitrogen Claude closed cycle 20 may provide the cooling duty with sufficiently low temperature for the gaseous hydrogen streams to be precooled to about 82K through the precooling main heat exchanger 606. In embodiments, the optimized nitrogen Claude closed cycle 20 may comprise devices: the precooling main heat exchanger 606, a second nitrogen circulation compressor 1700, a warm nitrogen turbo-expander 1004, a cold nitrogen turbo-expander 1006, a second circulation liquid nitrogen pressure let-down valve 1008, an intermediate-pressure nitrogen thermosiphon vessel 1010, a first circulation liquid nitrogen pressure let-down valve 1012, a low-pressure nitrogen thermosiphon vessel 1014, a first nitrogen circulation compressor 1800, a common integral-gear 1020, as well as streams: an intermediate-pressure circulation gaseous nitrogen stream 500, a mixed intermediate-pressure circulation gaseous nitrogen stream 502, the high-pressure circulation nitrogen stream 506, a side-stream warm nitrogen turbo-expander feed stream 508, a warm nitrogen turbo-expander discharge stream 510, a second nitrogen mixed stream 512, a side-stream cold nitrogen turbo-expander feed stream 516, a cold nitrogen turbo-expander discharge stream 518, a first nitrogen mixed stream 520, a subcooled high-pressure circulation liquid nitrogen stream 522, a second subcooled high-pressure circulation liquid nitrogen stream 524, an intermediate-pressure cold circulation nitrogen stream 526, an intermediate-pressure thermosiphon nitrogen vapor stream 528, an intermediate-pressure thermosiphon nitrogen liquid stream 530, an intermediate-pressure thermosiphon nitrogen mixed stream 532, a first subcooled high-pressure circulation liquid nitrogen stream 534, a low-pressure cold circulation nitrogen stream 536, a low-pressure thermosiphon nitrogen vapor stream 538, a low-pressure thermosiphon nitrogen liquid stream 540, a low-pressure thermosiphon nitrogen mixed stream 542, a low-pressure circulation gaseous nitrogen stream 544, and a first nitrogen circulation compressor discharge stream 548, as shown in FIG. 1.

In embodiments, the high-pressure circulation nitrogen stream 506 may enter pass 1-1 from the warm end of the precooling main heat exchanger 606, wherein the high-pressure circulation nitrogen stream 506 may exchange heat with the cold stream passes 1-2, 1-4, 1-5 and 1-7. In embodiments, the side-stream warm nitrogen turbo-expander feed stream 508 may exit pass 1-1, wherein the side-stream warm nitrogen turbo-expander feed stream 508 may comprise a temperature of about 286K. Further, in embodiments the side-stream cold nitrogen turbo-expander feed stream 516 may also exit from pass 1-1, wherein the side-stream cold nitrogen turbo-expander feed stream 516 may comprise a temperature of about 174K. In embodiments, the remainder of the high-pressure circulation nitrogen stream 506 may continue travelling towards an outlet at the cold end of the precooling main heat exchanger 606. In embodiments, the high-pressure circulation nitrogen stream 506 may also exit the precooling main heat exchanger 606 as the subcooled high-pressure circulation liquid nitrogen stream 522, wherein the subcooled high-pressure circulation liquid nitrogen stream 522 may comprise a temperature of about 111K and a pressure of about 4380 kPa·G.

In embodiments, the subcooled high-pressure circulation liquid nitrogen stream 522 may be split into two streams. In embodiments, the first split stream may be the first subcooled high-pressure circulation liquid nitrogen stream 534. In embodiments, the second split stream may be the second subcooled high-pressure circulation liquid nitrogen stream 524.

In embodiments, the first subcooled high-pressure circulation liquid nitrogen stream 534 may enter the first circulation liquid nitrogen pressure let-down valve 1012, wherein the pressure of the first subcooled high-pressure circulation liquid nitrogen stream 534 may be reduced to 40 kPa·G and the temperature of the first subcooled high-pressure circulation liquid nitrogen stream 534 may be reduced to about 80.3K after its pressure reduction. In embodiments, the first circulation liquid nitrogen pressure let-down valve 1012 may comprise a J/T valve. In embodiments, the first subcooled high-pressure circulation liquid nitrogen stream 534 may exit the first circulation liquid nitrogen pressure let-down valve 1012 as the low-pressure cold circulation nitrogen stream 536. In embodiments, due to the isenthalpic pressure drop through the first circulation liquid nitrogen pressure let-down valve 1012, there may be about 35% nitrogen vapor flash-out from the low-pressure cold circulation nitrogen stream 536. In embodiments, the two-phase low-pressure cold circulation nitrogen stream 536 may be introduced to the low-pressure nitrogen thermosiphon vessel 1014, wherein the liquid and vapor in the low-pressure cold circulation nitrogen stream 536 may be separated into the low-pressure thermosiphon nitrogen liquid stream 540 and the low-pressure thermosiphon nitrogen vapor stream 538. In embodiments, the low-pressure thermosiphon nitrogen liquid stream 540 may flow to the pass 1-4 inlet at the cold end of the precooling main heat exchanger 606, wherein the low-pressure thermosiphon nitrogen liquid stream 540 may vaporize while traveling upward in pass 1-4 to provide cooling to the warm stream passes 1-3, 1-6 and 1-8 at the cold-end section of the precooling main heat exchanger 606. In embodiments, the low-pressure thermosiphon nitrogen liquid stream 540 may completely vaporize at the midway of pass 1-4, wherein the low-pressure thermosiphon nitrogen liquid stream 540 may comingle with the low-pressure thermosiphon nitrogen vapor stream 538 to form the low-pressure thermosiphon nitrogen mixed stream 542 and then further travel upward in pass 1-4 to provide cooling to the warm passes 1-1, 1-3, 1-6 and 1-8 at the upper section of the precooling main heat exchanger 606. In embodiments, the low-pressure thermosiphon nitrogen mixed stream 542 may exit the precooling main heat exchanger 606 as the low-pressure circulation gaseous nitrogen stream 544. In embodiments, the low-pressure circulation gaseous nitrogen stream 544 may comprise a temperature of about 311K.

In embodiments, the low-pressure circulation gaseous nitrogen stream 544 may comprise a pressure of about 30 kPa·G kPa·G and a temperature of about 311K. In embodiments, the low-pressure circulation gaseous nitrogen stream 544 may enter a first nitrogen circulation compressor 1800, wherein the pressure of the low-pressure circulation gaseous nitrogen stream 544 may be increased to about 525 kPa·G. In embodiments, the low-pressure circulation gaseous nitrogen stream 544 may exit the first nitrogen circulation compressor 1800 as a stream 548.

In embodiments, the first nitrogen circulation compressor discharge stream 548 may comingle with the intermediate-pressure circulation gaseous nitrogen stream 500 to form the mixed intermediate-pressure circulation gaseous nitrogen stream 502, wherein the mixed intermediate-pressure circulation gaseous nitrogen stream 502 may become the first stage feed stream to a second nitrogen circulation compressor 1700.

Returning to the first nitrogen circulation compressor 1800, in embodiments the first nitrogen circulation compressor 1800 may comprise a multistage compressor with a cooler on each stage discharge (details not shown). More particularly, in embodiments the first nitrogen circulation compressor 1800 may be a two-stage or a three-stage oil-free reciprocating compressor with a first stage suction pressure of about 30 kPa·G and a last stage discharge pressure of about 525 kPa·G. Further, in embodiments the first nitrogen circulation compressor 1800 may comprise a two-stage or a three-stage integrally-geared type centrifugal compressor with a first stage suction pressure of about 30 kPa·G and a last stage discharge pressure of about 525 kPa·G.

Returning to the second subcooled high-pressure circulation liquid nitrogen stream 524, in embodiments the second subcooled high-pressure circulation liquid nitrogen stream 524 may enter the second circulation liquid nitrogen pressure let-down valve 1008. In embodiments, the second subcooled high-pressure circulation liquid nitrogen stream 524 may be reduced in pressure to about 565 kPa·G and may be reduced in temperature to about 98K after its pressure reduction. In embodiments, the second circulation liquid nitrogen pressure let-down valve 1008 may comprise a J/T valve. In embodiments, the second subcooled high-pressure circulation liquid nitrogen stream 524 may exit the second circulation liquid nitrogen pressure let-down valve 1008 as the intermediate-pressure cold circulation nitrogen stream 526. In embodiments, due to the isenthalpic pressure drop occurring as the second subcooled high-pressure circulation liquid nitrogen stream 526 passes through the second circulation liquid nitrogen pressure let-down valve 1008, there may be about 18% nitrogen vapor flash-out from the intermediate-pressure cold circulation nitrogen stream 526. In embodiments, the two-phase intermediate-pressure cold circulation nitrogen stream 526 may enter the intermediate-pressure nitrogen thermosiphon vessel 1010, wherein the liquid and vapor in the intermediate-pressure cold circulation nitrogen stream 526 may be separated into the intermediate-pressure thermosiphon nitrogen liquid stream 530 and the intermediate-pressure thermosiphon nitrogen vapor stream 528. In embodiments, the intermediate-pressure thermosiphon nitrogen liquid stream 530 may proceed to enter the pass 1-2 inlet at the low section of the precooling main heat exchanger 606, wherein the intermediate-pressure thermosiphon nitrogen liquid stream 530 may vaporize while traveling upwards in pass 1-2 providing cooling to the warm stream passes 1-3 and 1-6 at the low section of the precooling main heat exchanger 606. In embodiments, the intermediate-pressure thermosiphon nitrogen liquid stream 530 may completely vaporize at the low section midway of pass 1-2, wherein the intermediate-pressure thermosiphon nitrogen liquid stream 530 may comingle with the intermediate-pressure thermosiphon nitrogen vapor stream 528 to become the intermediate-pressure thermosiphon nitrogen mixed stream 532. In embodiments, the intermediate-pressure thermosiphon nitrogen mixed stream 532 may then further travel upward in pass 1-2 to provide cooling to the warm passes 1-3 and 1-6 at the low section of the precooling main heat exchanger 606 until the intermediate-pressure thermosiphon nitrogen mixed stream 532 mixes with the cold nitrogen turbo-expander discharge stream 518 at a temperature of about 105K to form the first nitrogen mixed stream 520. In embodiments, the first nitrogen mixed stream 520 may continue traveling upward in pass 1-2 to provide cooling to warm passes 1-1, 1-3 and 1-6 at the mid-section of the precooling main heat exchanger 606 until the first nitrogen mixed stream 520 mixes with a warm nitrogen turbo-expander discharge stream 510 at a temperature of about 180K to form the second nitrogen mixed stream 512. In embodiments, the second nitrogen mixed stream 512 may continue traveling upward in pass 1-2 to provide cooling to warm passes 1-1, 1-3 and 1-6 at the upper section of the precooling main heat exchanger 606 until the second nitrogen mixed stream 512 exits from the warm end of the precooling main heat exchanger 606 at a temperature of about 311K as the intermediate-pressure circulation gaseous nitrogen stream 500. In embodiments, the intermediate-pressure circulation gaseous nitrogen stream 500 may commingle with the first nitrogen circulation compressor discharge stream 548 to form the mixed intermediate-pressure circulation gaseous nitrogen stream 502, which may proceed to the second nitrogen circulation compressor 1700.

Returning to the side-stream warm nitrogen turbo-expander feed stream 508, in embodiments the side-stream warm nitrogen turbo-expander feed stream 508 may comprise a pressure of about 4410 kPa·G and a temperature of about 286K. In embodiments, the side-stream warm nitrogen turbo-expander feed stream 508 may enter the warm nitrogen turbo-expander 1004, wherein the side-stream warm nitrogen turbo-expander feed stream 508 may be expanded to a lower pressure of about 543 kPa·G, which may result in a lower temperature of about 180K through a nearly isentropic expansion. In embodiments, the side-stream warm nitrogen turbo-expander feed stream 508 may exit the warm nitrogen turbo-expander 1004 as the warm nitrogen turbo-expander discharge stream 510. In embodiments, the warm nitrogen turbo-expander discharge stream 510 may be routed into pass 1-2 of the precooling main heat exchanger 606, wherein the warm nitrogen turbo-expander discharge stream 510 may mix with the cold upcoming gaseous nitrogen 520 to provide cooling to the warm stream passes of the precooling main heat exchanger 606.

Returning to the side-stream cold nitrogen turbo-expander feed stream 516, in embodiments the side-stream cold nitrogen turbo-expander feed stream 516 may comprise a pressure of about 4,395 kPa·G and a temperature of about 174K. In embodiments, the side-stream cold nitrogen turbo-expander feed stream 516 may enter the cold nitrogen turbo-expander 1006, where the side-stream cold nitrogen turbo-expander feed stream 516 may be expanded to a lower pressure of about 560 kPa·G resulting in a lower temperature of about 105K through a nearly isentropic expansion. In embodiments, the side-stream cold nitrogen turbo-expander feed stream 516 may exit the cold nitrogen turbo-expander 1006 as the cold nitrogen turbo-expander discharge stream 518. In embodiments, the cold nitrogen turbo-expander discharge stream 518 may enter pass 1-2 of the precooling main heat exchanger 606, where the cold nitrogen turbo-expander discharge stream 518 may mix with the intermediate-pressure thermosiphon nitrogen mixed stream 532 to provide cooling to the warm stream passes of the precooling main heat exchanger 606.

In embodiments, the warm nitrogen turbo-expander 1004 and the cold nitrogen turbo-expander 1006 are so arranged in parallel with about the same expansion pressure ratio in range of 7 to 8, but with different inlet and outlet temperatures fitting to the optimized nitrogen Claude closed cycle 20, for better optimization for the hot and cold temperature composite profile of the precooling main heat exchanger 606 and therefore resulting in better refrigeration efficiency for the optimized nitrogen Claude closed cycle 20.

Returning to the mixed intermediate-pressure circulation gaseous nitrogen stream 502, in embodiments the mixed intermediate-pressure circulation gaseous nitrogen stream 502 may comprise a pressure of about 525 kPa·G kPa·G and a temperature of about 311K. In embodiments, the mixed intermediate-pressure circulation gaseous nitrogen stream 502 may enter the second nitrogen circulation compressor 1700, wherein the pressure of the mixed intermediate-pressure circulation gaseous nitrogen stream 502 may be increased to about 4425 kPa·G. In embodiments, the mixed intermediate-pressure circulation gaseous nitrogen stream 502 may exit the second nitrogen circulation compressor 1700 as the second nitrogen circulation compressor discharge stream 506. In embodiments, at this point at the second nitrogen circulation compressor discharge stream 506, the optimized nitrogen Claude closed cycle 20 may be closed.

In embodiments, the second nitrogen circulation compressor 1700 may comprise a multistage compressor with a cooler on each stage discharge (details not shown). In embodiments, more particularly the second nitrogen circulation compressor 1700 may comprise a four-stage integrally-geared type centrifugal compressor that may be integrated with the warm nitrogen turbo-expander 1004 and the cold nitrogen turbo-expander 1006 by the common integral-gear 1020 to form an integrated nitrogen compander 1600. In embodiments, the integrated nitrogen compander 1600 may be driven either by an electrical motor, a gas turbine, or a steam turbine.

In embodiments, the following devices and their associated piping valves, etc. with operation temperature ranges of 82K-313K may be installed into a warm temperature coldbox 1200 for insulation purposes: the hydrogen purification absorption bed 608, the hydrogen purification absorption bed 610, the fixed-bed catalyst ortho-para hydrogen converter 612, the first circulation liquid nitrogen pressure let-down valve 1012, the low-pressure nitrogen thermosiphon vessel 1014, the second circulation liquid nitrogen pressure let-down valve 1008, and the intermediate-pressure nitrogen thermosiphon vessel 1010. More particularly, in embodiments the warm temperature coldbox 1200 may be filled with perlites and continuously purged by a dry nitrogen stream (details not shown) to provide insulation.

In embodiments, the optimized hydrogen Claude half-opened cycle 10 may begin with a high-pressure circulation hydrogen stream 206 comprising a pressure within the range of 3500 kPa·G to 4400 kPa·G and a temperature of about 313K. In embodiments, the optimized hydrogen Claude half-opened cycle 10 may provide the cooling duty with sufficiently low temperature for gaseous hydrogen to be liquefied. In embodiments, the optimized hydrogen Claude half-open cycle system 10 may comprise the devices: the intermediate temperature main heat exchanger 614, a cold temperature main heat exchanger 616, a second hydrogen exp-compressor 700, a first hydrogen exp-compressor 702, an exp-compressor discharge cooler 704, a first hydrogen turbo-expander 708, a second hydrogen turbo-expander 710, a first circulation liquid hydrogen pressure let-down valve 800, a low-pressure hydrogen thermosiphon vessel 802, a second circulation liquid hydrogen pressure let-down valve 900, an intermediate-pressure hydrogen thermosiphon vessel 902, the second hydrogen circulation compressor 1100, a first hydrogen circulation compressor 1500, as well as streams: high-pressure circulation hydrogen stream 206, first cold high-pressure circulation hydrogen stream 208, second cold high-pressure circulation hydrogen stream 302, subcooled high-pressure circulation liquid hydrogen stream 304, first subcooled high-pressure circulation liquid hydrogen stream 306, low-pressure cold circulation hydrogen stream 308, low-pressure thermosiphon hydrogen liquid stream 312, low-pressure thermosiphon hydrogen vapor stream 310, mixed first hydrogen thermosiphon vapor stream 142, cold low-pressure circulation gaseous hydrogen stream 146, intermediate temperature low-pressure circulation gaseous hydrogen stream 148, low-pressure circulation gaseous hydrogen stream 150, first hydrogen circulation compressor discharge stream 154, second subcooled high-pressure circulation liquid hydrogen stream 400, intermediate-pressure cold circulation hydrogen stream 402, intermediate-pressure thermosiphon hydrogen liquid stream 406, intermediate-pressure thermosiphon hydrogen vapor stream 404, first cold intermediate-pressure circulation gaseous hydrogen stream 410, first hydrogen turbo-expander feed stream 210, first hydrogen turbo-expander discharge stream 212, second hydrogen turbo-expander discharge stream 214, second cold intermediate-pressure circulation gaseous hydrogen stream 216, intermediate temperature intermediate-pressure circulation gaseous hydrogen stream 218, intermediate-pressure circulation gaseous hydrogen stream 220, mixed intermediate-pressure circulation gaseous hydrogen stream 156, second hydrogen circulation compressor final stage discharge stream 112, second split gaseous hydrogen stream 200, second hydrogen exp-compressor discharge stream 202, first hydrogen exp-compressor discharge stream 204, as shown in FIG. 1.

In embodiments, the high-pressure circulation hydrogen stream 206 may enter pass 1-6 from the warm end of the precooling main heat exchanger 606, wherein the high-pressure circulation hydrogen stream 206 may be cooled by the cold stream passes 1-2, 1-4, 1-5 and 1-7 to a temperature of about 82K. In embodiments, the high-pressure circulation hydrogen stream 206 may exit the precooling main heat exchanger 606 from its cold end as a first cold high-pressure circulation hydrogen stream 208.

In embodiments, the first cold high-pressure circulation hydrogen stream 208 may be routed to enter pass 5-3 from the warm end of the intermediate temperature main heat exchanger 614, wherein the first cold high-pressure circulation hydrogen stream 208 may exchange heat with the cold stream passes 5-2 and 5-4. In embodiments, a side-stream, a first hydrogen turbo-expander feed stream 210, may be withdrawn from the midway of pass 5-3. In embodiments, the first hydrogen turbo-expander feed stream 210 may comprise a temperature in the range of about 61K to 65K. In embodiments, the remainder of the first cold high-pressure circulation hydrogen stream 208 may travel to the cold end outlet of the intermediate temperature main heat exchanger 614. In embodiments, the first cold high-pressure circulation hydrogen stream 208 may exit the intermediate temperature main heat exchanger 614 as a second cold high-pressure circulation hydrogen stream 302. In embodiments, the second cold high-pressure circulation hydrogen stream 302 may comprise a temperature of about 40K.

In embodiments, the second cold high-pressure circulation hydrogen stream 302 may proceed to pass 6-3 of the cold temperature main heat exchanger 616, wherein the second cold high-pressure circulation hydrogen stream 302 may exchange heat with the cold stream passes 6-2 and 6-4. In embodiments, the second cold high-pressure circulation hydrogen stream 302 may exit the cold temperature main heat exchanger 616 as a subcooled liquid hydrogen 304 comprising a temperature of about 32K, from the cold end outlet of the cold temperature main heat exchanger 616. In embodiments, the subcooled high-pressure circulation liquid hydrogen stream 304 may comprise a pressure within the range of 3,370 kPa·G to 4270 kPa·G and a temperature of about 32K. In embodiments, the subcooled high-pressure circulation liquid hydrogen stream 304 may split into two streams: a first subcooled high-pressure circulation liquid hydrogen stream 306 and a second subcooled high-pressure circulation liquid hydrogen stream 400.

In embodiments, the first subcooled high-pressure circulation liquid hydrogen stream 306 may enter a first circulation liquid hydrogen pressure let-down valve 800. In embodiments, the first circulation liquid hydrogen pressure let-down valve 800 may comprise a J/T valve. In embodiments, the pressure of the first subcooled high-pressure circulation liquid hydrogen stream 306 may be reduced to about 50 kPa·G, and the temperature of the first subcooled high-pressure circulation liquid hydrogen stream 306 may be reduced to about 21.7K after the pressure reduction. In embodiments, the first subcooled high-pressure circulation liquid hydrogen stream 306 may exit the first circulation liquid hydrogen pressure let-down valve 800 as a low-pressure cold circulation hydrogen stream 308. In embodiments, due to the isenthalpic pressure drop through the valve 800, there may be about 35%-36% hydrogen vapor flash-out from the low-pressure cold circulation hydrogen stream 308. In embodiments, the two-phase low-pressure cold circulation hydrogen stream 308 may enter a low-pressure hydrogen thermosiphon vessel 802, wherein the liquid and vapor of the low-pressure cold circulation hydrogen stream 308 may be separated into a low-pressure thermosiphon hydrogen liquid stream 312 and the low-pressure thermosiphon hydrogen vapor stream 310. In embodiments, the low-pressure thermosiphon hydrogen liquid stream 312 may flow to pass 6-2 from the cold end of the cold temperature main heat exchanger 616. In embodiments, the low-pressure thermosiphon hydrogen liquid stream 312 may vaporize while traveling upward in pass 6-2 to provide cooling to the warm stream passes 6-1 and 6-3 at the cold-end section of the cold temperature main heat exchanger 616 and may totally vaporize at the midway of pass 6-2. In embodiments, the low-pressure thermosiphon hydrogen liquid stream 312 may comingle with the mixed first hydrogen thermosiphon vapor stream 142 to form a mixed low-pressure thermosiphon hydrogen stream 144. In embodiments, the mixed low-pressure thermosiphon hydrogen stream 144 may further travel upward in pass 6-2 to provide cooling to the warm passes 6-1 and 6-3 at the upper section of the cold temperature main heat exchanger 616. In embodiments, a mixed low-pressure thermosiphon hydrogen stream 144 may exit the cold temperature main heat exchanger 616 as a cold low-pressure circulation gaseous hydrogen stream 146. In embodiments, the cold low-pressure circulation gaseous hydrogen stream 146 may comprise an increased temperature of about 38.5K after exchanging heat with the warm stream passes 6-1 and 6-3.

In embodiments, the cold low-pressure circulation gaseous hydrogen stream 146 may comprise a pressure of about 44 kPa·G and a temperature of about 38.5K. In embodiments, the cold low-pressure circulation gaseous hydrogen stream 146 may enter pass 5-2 from the cold end of the intermediate temperature main heat exchanger 614, wherein the cold low-pressure circulation gaseous hydrogen stream 146 may exchange heat with the warm stream passes 5-1 and 5-3. In embodiments, the temperature of the cold low-pressure circulation gaseous hydrogen stream 146 may be increased to about 80.3K. In embodiments, the cold low-pressure circulation gaseous hydrogen stream 146 may exit the warm end of the exchanger 614 as an intermediate temperature low-pressure circulation gaseous hydrogen stream 148.

In embodiments, the intermediate temperature low-pressure circulation gaseous hydrogen stream 148 may comprise a pressure of about 36.5 kPa·G and a temperature of about 80.3K. In embodiments, the intermediate temperature low-pressure circulation gaseous hydrogen stream 148 may be routed to enter pass 1-5 from the cold end of the precooling main heat exchanger 606, wherein the intermediate temperature low-pressure circulation gaseous hydrogen stream 148 may exchange heat with the warm stream passes 1-1, 1-3, 1-6 and 1-8. In embodiments, the temperature of the intermediate temperature low-pressure circulation gaseous hydrogen stream 148 may be increased to about 311K. In embodiments, the intermediate temperature low-pressure circulation gaseous hydrogen stream 148 may exit the exchanger 606 as a low-pressure circulation gaseous hydrogen stream 150.

In embodiments, the low-pressure circulation gaseous hydrogen stream 150 may comprise a pressure of about 29 kPa·G and a temperature of about 311K. In embodiments, the low-pressure circulation gaseous hydrogen stream 150 may proceed to a first hydrogen circulation compressor 1500, wherein the pressure of the low-pressure circulation gaseous hydrogen stream 150 may be increased to about 790 kPa·G. In embodiments, the low-pressure circulation gaseous hydrogen stream 150 may exit the first hydrogen circulation compressor 1500 as a first hydrogen circulation compressor discharge stream 154.

In embodiments, the first hydrogen circulation compressor 1500 may comprise a multistage compressor with a cooler on each stage discharge (details not shown). More particularly, in embodiments the first hydrogen circulation compressor 1500 may comprise a two-stage or three-stage oil-free reciprocating compressor with a first stage suction pressure of about 29 kPa·G and a last stage discharge pressure of about 790 kPa·G.

In embodiments, the first hydrogen circulation compressor discharge stream 154 may comingle with an intermediate-pressure circulation gaseous hydrogen stream 220 to form the mixed intermediate-pressure circulation gaseous hydrogen stream 156 as the first stage feed stream to the second hydrogen circulation compressor 1100.

Returning to the second subcooled high-pressure circulation liquid hydrogen stream 400, in embodiments the second subcooled high-pressure circulation liquid hydrogen stream 400 may be split from the subcooled high-pressure circulation liquid hydrogen stream 304. In embodiments, the second subcooled high-pressure circulation liquid hydrogen stream 400 may enter a second circulation liquid hydrogen pressure let-down valve 900. In embodiments, the second circulation liquid hydrogen pressure let-down valve 900 may comprise a J/T valve. In embodiments, the second subcooled high-pressure circulation liquid hydrogen stream 400 may exit the second circulation liquid hydrogen pressure let-down valve 900 as an intermediate-pressure cold circulation hydrogen stream 402. In embodiments, the intermediate-pressure cold circulation hydrogen stream 402 may comprise a reduced pressure of about 815 kPa·G and a reduced temperature of about 30.7K. In embodiments, due to the isenthalpic pressure drop through the second circulation liquid hydrogen pressure let-down valve 900, there may be about 3% to 4% hydrogen vapor flash-out from the intermediate-pressure cold circulation hydrogen stream 402. In embodiments, the two-phase intermediate-pressure cold circulation hydrogen stream 402 may enter an intermediate-pressure hydrogen thermosiphon vessel 902, wherein the liquid and vapor of the intermediate-pressure cold circulation hydrogen stream 402 may be separated to form the following: an intermediate-pressure thermosiphon hydrogen liquid stream 406 and an intermediate-pressure thermosiphon hydrogen vapor stream 404. In embodiments, the intermediate-pressure thermosiphon hydrogen liquid stream 406 may proceed to enter pass 6-4 at the middle of cold temperature main heat exchanger 616. In embodiments, the intermediate-pressure thermosiphon hydrogen liquid stream 406 may be vaporized while traveling upward in pass 6-4 to provide cooling to the warm stream passes 6-1 and 6-3 at the middle section of the cold temperature main heat exchanger 616 and may become total vapor at the midway of pass 6-4.

In embodiments, the intermediate-pressure thermosiphon hydrogen liquid stream 406 may comingle with the intermediate-pressure thermosiphon hydrogen vapor stream 404 to form an intermediate-pressure thermosiphon hydrogen mixed stream 408. In embodiments, the intermediate-pressure thermosiphon hydrogen mixed stream 408 may then further travel upward in pass 6-4 to provide cooling to the warm passes 6-1 and 6-3 at the upper section of the exchanger 616.

In embodiments, the intermediate-pressure thermosiphon hydrogen mixed stream 408 may exit the cold temperature main heat exchanger 616 as a first cold intermediate-pressure circulation gaseous hydrogen stream 410. In embodiments, the temperature of the first cold intermediate-pressure circulation gaseous hydrogen stream 410 may be at about 38.5K after exchanging heat with the warm stream passes 6-1 and 6-3. In embodiments, the first cold intermediate-pressure circulation gaseous hydrogen stream 410 may comingle with a second hydrogen turbo-expander discharge stream 214 to form a second cold intermediate-pressure circulation gaseous hydrogen stream 216.

In embodiments, the second cold intermediate-pressure circulation gaseous hydrogen stream 216 may comprise a pressure of about 805 kPa·G and a temperature of about 38.5K. In embodiments, the second cold intermediate-pressure circulation gaseous hydrogen stream 216 may proceed to enter pass 5-4 from the cold end of the intermediate temperature main heat exchanger 614, wherein the second cold intermediate-pressure circulation gaseous hydrogen stream 216 may exchange heat with the warm stream passes 5-1 and 5-3. In embodiments, the temperature of the second cold intermediate-pressure circulation gaseous hydrogen stream 216 may be increased to about 80.3K. In embodiments, the second cold intermediate-pressure circulation gaseous hydrogen stream 216 may exit the intermediate temperature main heat exchanger 614 from its warm end as an intermediate temperature intermediate-pressure circulation gaseous hydrogen stream 218.

In embodiments, the intermediate temperature intermediate-pressure circulation gaseous hydrogen stream 218 may comprise a pressure of about 797 kPa·G and a temperature of about 80.3K. In embodiments, the intermediate temperature intermediate-pressure circulation gaseous hydrogen stream 218 may proceed to enter pass 1-7 from the cold end of the precooling main heat exchanger 606, wherein the intermediate temperature intermediate-pressure circulation gaseous hydrogen stream 218 may exchange heat with the warm stream passes 1-1, 1-3, 1-6 and 1-8. In embodiments, the temperature of the intermediate temperature intermediate-pressure circulation gaseous hydrogen stream 218 may be increased to about 311K. In embodiments, the intermediate temperature intermediate-pressure circulation gaseous hydrogen stream 218 may exit the precooling main heat exchanger 606 from its warm end as the intermediate-pressure circulation gaseous hydrogen stream 220.

As previously described, in embodiments the intermediate-pressure circulation gaseous hydrogen stream 220 may mix with the first hydrogen circulation compressor discharge stream 154 to form the mixed intermediate-pressure circulation gaseous hydrogen stream 156 as the first stage feed stream to the second hydrogen circulation compressor 1100.

Returning to the first hydrogen turbo-expander feed stream 210, in embodiments the first hydrogen turbo-expander feed stream 210 may comprise a pressure within the range of 3410 kPa·G to 4310 kPa·G and temperature within the range of about 61K to 65K. In embodiments, the first hydrogen turbo-expander feed stream 210 may proceed to enter a first hydrogen turbo-expander 708, wherein the first hydrogen turbo-expander feed stream 210 may be expanded to a lower pressure through a nearly isentropic expansion. In embodiments, the first hydrogen turbo-expander feed stream 210 may exit the first hydrogen turbo-expander 708 as a first hydrogen turbo-expander discharge stream 212. In embodiments, the first hydrogen turbo-expander discharge stream 212 may then be expanded further by a second hydrogen turbo-expander 710 to a pressure of about 805 kPa·G and a temperature of about 38K through a nearly isentropic expansion also. In embodiments, the first hydrogen turbo-expander discharge stream 212 may exit the second hydrogen turbo-expander 710 as the second hydrogen turbo-expander discharge stream 214.

As descripted above, in embodiments the second hydrogen turbo-expander discharge stream 214 then may mix with the first cold intermediate-pressure circulation gaseous hydrogen stream 410 to form the cold intermediate-pressure circulation gaseous hydrogen stream 216, which may be routed to enter pass 5-4 of the intermediate temperature main heat exchanger 614 as a cold stream to provide cooling to the warm stream passes 5-1 and 5-3.

Returning to the second split gaseous hydrogen stream 200, in embodiments the second split gaseous hydrogen stream 200 may comprise a pressure within the range of 3200 kPa·G to 4000 kPa·G and a temperature of about 313K. In embodiments, the second split gaseous hydrogen stream 200 may proceed to a second hydrogen exp-compressor 700, wherein the pressure of the second split gaseous hydrogen stream 200 may be increased. In embodiments, the second split gaseous hydrogen stream 200 may exit the second hydrogen exp-compressor 700 as a second hydrogen exp-compressor discharge stream 202. In embodiments, the pressure of the second hydrogen exp-compressor discharge stream 202 may then be further boosted by a first hydrogen exp-compressor 702. In embodiments, the second hydrogen exp-compressor discharge stream 202 may exit the first hydrogen exp-compressor 702 as a first hydrogen exp-compressor discharge stream 204. In embodiments, depending on the pressure of the first hydrogen exp-compressor discharge stream 204 at operation, the first hydrogen exp-compressor discharge stream 204 may be at a pressure within the range of about 3,500 kPa·G to about 4,400 kPa·G and a temperature of about 325K. In embodiments, the temperature of the first hydrogen exp-compressor discharge stream 204 may be reduced to about 313K by an exp-compressor discharge cooler 704. In embodiments, the first hydrogen exp-compressor discharge stream 204 may exit the exp-compressor discharge cooler 704 as the high-pressure circulation hydrogen stream 206, upon which the optimized hydrogen Claude half-opened cycle 10 may be closed.

In embodiments, the first hydrogen exp-compressor 702 may be driven by the first hydrogen turbo-expander 708, and the second hydrogen exp-compressor 700 may be driven by the second hydrogen turbo-expander 710, respectively. In embodiments, the first hydrogen exp-compressor 702 and the first hydrogen turbo-expander 708 may form the first expander set, while the second hydrogen exp-compressor 700 and the second hydrogen turbo-expander 710 may form the second expander set. In embodiments, this setup with two sets of expanders in serial configuration fitting to the optimized hydrogen Claude half-opened cycle 10 may make the cycle simple and easier for operation.

In embodiments, the two expander sets are so configured in serial connection with the pressure ratio at desirable values to obtain optimal expander set frame-sizes, in terms of technical feasibility for achieving the optimal efficiencies to expand and compress the gaseous hydrogen streams.

More particularly, in embodiments both the first expander set and second expander set may be magnetic bearing type, which is a shelf-available, widely-used standard machine in many industries.

In embodiments, the following devices and their associated piping valves, etc. with operation temperature range 20K-82K may be installed into the cold temperature coldbox 1400 for insulation purposes: product liquid hydrogen pressure let-down valve 618, the liquid hydrogen storage tank pressure control valve 622; the first circulation liquid hydrogen pressure let-down valve 800; the low-pressure hydrogen thermosiphon vessel 802; the second circulation liquid hydrogen pressure let-down valve 900; the intermediate-pressure hydrogen thermosiphon vessel 902; the first hydrogen turbo-expander 708; the second hydrogen turbo-expander 710; the intermediate temperature main heat exchanger 614; and cold temperature main heat exchanger 616.

More particularly, in embodiments, the cold temperature coldbox 1400 may comprise an MLI (multilayer insulation) vacuum insulated enclosure to provide super insulation.

FIG. 2 illustrates an embodiment of a hydrogen liquefaction system similar to FIG. 1. However, in the embodiment in FIG. 2, the first nitrogen circulation compressor 1800 may be combined with the integrated nitrogen compander 1600 on the same integral-gear 1020. Further, in embodiments the first hydrogen circulation compressor 1500 and the second hydrogen circulation compressor 1100 may be combined with a common integrated crank shaft 628 to form an integrated hydrogen circulation compressor 1900.

What is claimed is:

1. A hydrogen liquefaction method, comprising:

providing a purified gaseous hydrogen feed stream, wherein the purified gaseous hydrogen feed stream comprises about 75% ortho-hydrogen and 25% para-hydrogen, and further wherein the purified gaseous hydrogen feed stream comprises a pressure within the range of 800 kPa·G to 4,000 kPa·G and a temperature of about 300K;

providing a first hydrogen circulation compressor and a second hydrogen circulation compressor, wherein the first hydrogen circulation compressor discharges a first hydrogen circulation compressor final stage discharge stream, and further wherein the second hydrogen circulation compressor discharges a second hydrogen circulation compressor final stage discharge stream;

combining the purified gaseous hydrogen feed stream and a mixed intermediate-pressure circulation gaseous hydrogen stream inside the second hydrogen circulation compressor forming the second hydrogen circulation compressor final stage discharge stream, wherein the second hydrogen circulation compressor final stage discharge stream comprises a higher pressure within the range of 3,200 kPa·G to 4,000 kPa·G;

splitting the second hydrogen circulation compressor final stage discharge stream into a first split gaseous hydrogen stream and a second split gaseous hydrogen stream;

cooling the first split gaseous hydrogen stream to about 82K inside a precooling main heat exchanger to form a first cold gaseous hydrogen stream;

purifying the first cold gaseous hydrogen stream inside a swing hydrogen absorption bed system to form a deep purified cold gaseous hydrogen stream;

passing the deep purified cold gaseous hydrogen stream through a fixed-bed catalyst ortho-para hydrogen converter, wherein the deep purified cold gaseous hydrogen stream forms a first p-H2 enriched gaseous hydrogen stream, wherein the first p-H2 enriched gaseous hydrogen stream comprises a new equilibrium composition of about 53% ortho-hydrogen and about 47% para-hydrogen, and further wherein the first p-H2 enriched gaseous hydrogen stream increases in temperature due to the exothermic process of the ortho to para hydrogen conversion;

cooling the first p-H2 enriched gaseous hydrogen stream inside the precooling main heat exchanger to form a first cold p-H2 enriched gaseous hydrogen stream, wherein the temperature of the first cold p-H2 enriched gaseous hydrogen stream is reduced to 82K;

cooling the first cold p-H2 enriched gaseous hydrogen stream inside a catalyst filled intermediate-temperature ortho-para hydrogen converter of an intermediate temperature main heat exchanger to form a second cold p-H2 enriched gaseous hydrogen stream, wherein the second cold p-H2 enriched gaseous hydrogen stream comprises a temperature of about 40K;

converting ortho-hydrogen to para-hydrogen in the second cold p-H2 enriched gaseous hydrogen stream inside the catalyst filled intermediate-temperature ortho-para hydrogen converter of the intermediate temperature main heat exchanger, wherein the second cold p-H2 enriched gaseous hydrogen stream comprises a new equilibrium composition of about 11% ortho-hydrogen and about 89% para-hydrogen;

cooling the second cold p-H2 enriched gaseous hydrogen stream inside a catalyst filled low-temperature ortho-para hydrogen converter of a cold temperature main heat exchanger to form a subcooled high-pressure p-H2 enriched liquid hydrogen stream, wherein the subcooled high-pressure p-H2 enriched liquid hydrogen stream comprises a temperature of about 23.5K;

converting ortho-hydrogen to para-hydrogen in the subcooled high-pressure p-H2 enriched liquid hydrogen stream inside the catalyst filled low-temperature ortho-para hydrogen converter of the cold temperature main heat exchanger, wherein the subcooled high-pressure p-H2 enriched liquid hydrogen stream comprises a new equilibrium composition of about 1% ortho-hydrogen and about 89% para-hydrogen;

reducing the pressure of the subcooled high-pressure p-H2 enriched liquid hydrogen stream with a Joule-Thomson valve (J/T valve) to form a low-pressure liquid hydrogen product stream, wherein the low-pressure liquid hydrogen product stream comprises a pressure of about 50 kPa·G and temperature of about 21.7K;

feeding the low-pressure liquid hydrogen product stream into a liquid hydrogen storage tank;

removing a flashed gaseous hydrogen stream from the liquid hydrogen storage tank through a pressure control valve;

feeding the flashed gaseous hydrogen stream into a liquid hydrogen storage tank pressure control valve, wherein the flashed gaseous hydrogen stream exits the liquid hydrogen storage tank pressure control valve as an optimized hydrogen Claude cycle hydrogen makeup stream; and sending the hydrogen Claude cycle hydrogen makeup stream to a hydrogen Claude half-opened cycle system, wherein the hydrogen Claude cycle hydrogen makeup stream mixes with a low-pressure thermosiphon hydrogen vapor stream to form a mixed first hydrogen thermosiphon vapor stream.

2. The hydrogen liquefaction method of claim 1, wherein the precooling main heat exchanger comprises a plate-fin brazed aluminum type heat exchanger.

3. The hydrogen liquefaction method of claim 1, wherein the intermediate temperature main heat exchanger comprises a plate-fin brazed aluminum type heat exchanger.

4. The hydrogen liquefaction method of claim 1, wherein the cold temperature main heat exchanger comprises a plate-fin brazed aluminum type heat exchanger.

5. The hydrogen liquefaction method of claim 1 further comprising the following steps:

providing a high-pressure circulation nitrogen stream, wherein the high-pressure circulation nitrogen stream comprises a pressure of about 4,425 kPa·G and a temperature of about 313K;

cooling the high-pressure circulation nitrogen stream inside the precooling main heat exchanger;

splitting the high-pressure circulation nitrogen stream into the following three streams: a warm nitrogen turbo-expander feed stream, wherein the warm nitrogen turbo-expander feed stream comprises a temperature of about 286K; a cold nitrogen turbo-expander feed stream, wherein the cold nitrogen turbo-expander feed stream comprises a temperature of about 174K; and a subcooled high-pressure circulation liquid nitrogen stream, wherein the subcooled high-pressure circulation liquid nitrogen stream comprises a temperature of about 111K;

splitting the subcooled high-pressure circulation liquid nitrogen stream into a first subcooled high-pressure circulation liquid nitrogen stream and a second subcooled high-pressure circulation liquid nitrogen stream;

feeding the first subcooled high-pressure circulation liquid nitrogen stream into a first circulation liquid nitrogen pressure let-down valve, wherein the pressure of the first subcooled high-pressure circulation liquid nitrogen stream is reduced to about 40 kPa·G, and further wherein the temperature of the first subcooled high-pressure circulation liquid nitrogen stream is reduced to about 80.3K;

introducing a low-pressure cold circulation nitrogen stream from the first circulation liquid nitrogen pressure let-down valve into a low-pressure nitrogen thermosiphon vessel, wherein the low-pressure cold circulation nitrogen stream is separated into a low-pressure thermosiphon nitrogen liquid stream and a low-pressure thermosiphon nitrogen vapor stream;

introducing the low-pressure thermosiphon nitrogen liquid stream into the precooling main heat exchanger;

totally vaporizing the low-pressure thermosiphon nitrogen liquid stream inside the precooling main heat exchanger;

mixing the totally vaporized low-pressure thermosiphon nitrogen liquid stream with the low-pressure thermosiphon nitrogen vapor stream in the precooling main heat exchanger to form a low-pressure thermosiphon nitrogen mixed stream;

warming the low-pressure thermosiphon nitrogen mixed stream in the precooling main heat exchanger;

flowing the warmed low-pressure thermosiphon nitrogen mixed stream out of the precooling main heat exchanger as a low-pressure circulation gaseous nitrogen stream, wherein the low-pressure circulation gaseous nitrogen stream is employed as a feed stream for a first nitrogen circulation compressor;

compressing the low-pressure circulation gaseous nitrogen stream inside the first nitrogen circulation compressor to a pressure about 525 kPa·G to form a first nitrogen circulation compressor discharge stream;

commingling the first nitrogen circulation compressor discharge stream from the first nitrogen circulation compressor with an intermediate-pressure circulation gaseous nitrogen stream to form a mixed intermediate-pressure circulation gaseous nitrogen stream;

flowing the second subcooled high-pressure circulation liquid nitrogen stream to a second circulation liquid nitrogen pressure let-down valve, wherein the pressure of the second subcooled high-pressure circulation liquid nitrogen stream is reduced to about 565 kPa·G, and further wherein the temperature of the second subcooled high-pressure circulation liquid nitrogen stream is reduced to about 98K;

removing an intermediate-pressure cold circulation nitrogen stream from the second circulation liquid nitrogen pressure let-down valve;

introducing the intermediate-pressure cold circulation nitrogen stream to an intermediate-pressure nitrogen thermosiphon vessel, wherein the intermediate-pressure cold circulation nitrogen stream is separated into an intermediate-pressure thermosiphon nitrogen liquid stream and an intermediate-pressure thermosiphon nitrogen vapor stream;

introducing the intermediate-pressure thermosiphon nitrogen liquid stream into the precooling main heat exchanger;

totally vaporizing the intermediate-pressure thermosiphon nitrogen liquid stream in the precooling main heat exchanger;

mixing the totally vaporized intermediate-pressure thermosiphon nitrogen liquid stream with the intermediate-pressure thermosiphon nitrogen vapor stream in the precooling main heat exchanger to form an intermediate-pressure thermosiphon nitrogen mixed stream;

warming the intermediate-pressure thermosiphon nitrogen mixed stream in the precooling main heat exchanger;

mixing the warmed intermediate-pressure thermosiphon nitrogen mixed stream with a cold nitrogen turbo-expander discharge stream to form a first nitrogen mixed stream, wherein the first nitrogen mixed stream comprises a temperature of about 105K;

warming the first nitrogen mixed stream in the precooling main heat exchanger;

mixing the warmed first nitrogen mixed stream with a warm nitrogen turbo-expander discharge stream to form a second nitrogen mixed stream, wherein the combined second nitrogen mixed stream comprises a temperature of about 180K;

warming the second nitrogen mixed stream in the precooling main heat exchanger to a temperature of about 311K;

flowing the second nitrogen mixed stream out of the precooling main heat exchanger as the intermediate-pressure circulation gaseous nitrogen stream;

expanding the high-pressure warm nitrogen turbo-expander feed stream in a warm nitrogen turbo-expander to form the warm nitrogen turbo-expander discharge stream, wherein the warm nitrogen turbo-expander discharge stream comprises a lower pressure of about 543 kPa·G and a temperature of about 180K;

expanding the high-pressure cold nitrogen turbo-expander feed stream in a cold nitrogen turbo-expander to form the cold nitrogen turbo-expander discharge stream, wherein the cold nitrogen turbo-expander discharge stream comprises a lower pressure of about 560 kPa·G and a temperature of about 105K; and compressing the mixed intermediate-pressure circulation gaseous nitrogen stream in a second nitrogen circulation compressor to the high-pressure circulation nitrogen stream, wherein the high-pressure circulation nitrogen stream comprises a pressure of about 4425 kPa·G.

6. The method of claim 5, further comprising a warm temperature coldbox, wherein the warm temperature coldbox comprises perlites, and further wherein the warm temperature coldbox comprises the precooling main heat exchanger, a first hydrogen purification absorption bed, a second hydrogen purification absorption bed, the fixed-bed catalyst ortho-para hydrogen converter, the first circulation liquid nitrogen pressure let-down valve, the low-pressure nitrogen thermosiphon vessel, the second circulation liquid nitrogen pressure let-down valve, and the intermediate-pressure nitrogen thermosiphon vessel.

7. The hydrogen liquefaction method of claim 5, wherein the first nitrogen circulation compressor comprises a multistage compressor with a cooler on each stage discharge.

8. The hydrogen liquefaction method of claim 7, wherein the first nitrogen circulation compressor comprises a two-stage oil-free reciprocating compressor.

9. The hydrogen liquefaction method of claim 7, wherein the first nitrogen circulation compressor comprises a three-stage oil-free reciprocating compressor.

10. The hydrogen liquefaction method of claim 5, wherein the second nitrogen circulation compressor comprises a multistage compressor with a cooler on each stage discharge.

11. The hydrogen liquefaction method of claim 10, wherein the second nitrogen circulation compressor comprises a four-stage integrally-geared type centrifugal compressor.

12. The hydrogen liquefaction method of claim 11, wherein the four-stage integrally-geared type centrifugal compressor is integrated with the warm nitrogen turbo expander and the cold nitrogen turbo-expander to form an integrated nitrogen compander.

13. The hydration liquefaction method of claim 5, wherein the warm nitrogen turbo-expander and the cold nitrogen turbo-expander are arranged in parallel with about the same expansion pressure ratio in range of 7 to 8.

14. The hydrogen liquefaction method of claim 5, wherein the first nitrogen circulation compressor is combined with the integrated nitrogen compander on a common integral-gear.

15. The hydrogen liquefaction method of claim 1, further comprising:

providing a high-pressure circulation hydrogen stream, wherein the high-pressure circulation hydrogen stream comprises a pressure within the range of about 3,500 kPa·G to 4,400 kPa·G and a temperature of about 313K;

cooling the high-pressure circulation hydrogen stream in the precooling main heat exchanger to form a first cold high-pressure circulation hydrogen stream, wherein the first cold high-pressure circulation hydrogen stream comprises a temperature of about 82K;

further cooling the first cold high-pressure circulation hydrogen stream in the intermediate temperature main heat exchanger, wherein a first hydrogen turbo-expander feeder stream is split from the first cold high-pressure circulation hydrogen stream in the intermediate temperature main heat exchanger, wherein the first hydrogen turbo-expander feeder stream proceeds to a first hydrogen turbo-expander, wherein a first hydrogen turbo-expander discharge stream exits the first hydrogen turbo-expander;

withdrawing a first hydrogen turbo-expander feed stream from the further cooled first cold high-pressure circulation hydrogen stream, wherein the first hydrogen turbo-expander feed stream comprises a temperature within the range of 61K to 65K, and further wherein the remaining further cooled first cold high-pressure circulation hydrogen stream is further cooled to a temperature of about 40K;

removing a second cold high-pressure circulation hydrogen stream from the intermediate temperature main heat exchanger;

cooling the second cold high-pressure circulation hydrogen stream in the cold temperature main heat exchanger to form a subcooled high-pressure circulation liquid hydrogen stream, wherein the subcooled high-pressure circulation liquid hydrogen stream comprises a temperature of about 32K;

splitting the subcooled high-pressure circulation liquid hydrogen stream into a first subcooled high-pressure circulation liquid hydrogen stream and a second subcooled high-pressure circulation liquid hydrogen stream;

reducing the pressure of the first subcooled high-pressure circulation liquid hydrogen stream in a first circulation liquid hydrogen pressure let-down valve to about 50 kPa·G forming a low-pressure cold circulation hydrogen stream, wherein the low-pressure cold circulation hydrogen stream comprises a temperature of about 21.7K, and further wherein the low-pressure cold circulation hydrogen stream comprises vapor flash-out;

separating the low-pressure cold circulation hydrogen stream in a low-pressure hydrogen thermosiphon vessel into the low-pressure thermosiphon hydrogen vapor stream and a low-pressure thermosiphon hydrogen liquid stream;

totally vaporizing the low-pressure thermosiphon hydrogen liquid in the cold temperature main heat exchanger;

mixing the totally vaporized low-pressure thermosiphon hydrogen liquid with the mixed first hydrogen thermosiphon vapor stream to form a mixed low-pressure thermosiphon hydrogen stream;

warming the mixed low-pressure thermosiphon hydrogen stream to form a cold low-pressure circulation gaseous hydrogen stream, wherein the cold low-pressure circulation gaseous hydrogen stream comprises a temperature of about 38.5K;

further warming the cold low-pressure circulation gaseous hydrogen stream in the intermediate temperature main heat exchanger to form an intermediate temperature low-pressure circulation gaseous hydrogen stream, wherein the intermediate temperature low-pressure circulation gaseous hydrogen stream comprises a temperature of about 80.3K;

further warming the intermediate temperature low-pressure circulation gaseous hydrogen stream in the precooling main heat exchanger to form a low-pressure circulation gaseous hydrogen stream, wherein the low-pressure circulation gaseous hydrogen stream comprises a temperature of about 311K;

compressing the low-pressure circulation gaseous hydrogen stream in the first hydrogen circulation compressor to form the first hydrogen circulation compressor discharge stream, wherein the first hydrogen circulation compressor discharge stream comprises a pressure of 790 kPa·G;

commingling the compressed first hydrogen circulation compressor discharge stream with an intermediate-pressure circulation gaseous hydrogen stream to form the mixed intermediate-pressure circulation gaseous hydrogen stream;

reducing the pressure of the second subcooled high-pressure circulation liquid hydrogen stream in a second circulation liquid hydrogen pressure let-down valve to form an intermediate-pressure cold circulation hydrogen stream, wherein the intermediate-pressure cold circulation hydrogen stream comprises a pressure of about 815 kPa·G and a temperature of about 30.7K, and further wherein the intermediate-pressure cold circulation hydrogen stream comprises vapor flash-out;

separating the intermediate-pressure cold circulation hydrogen stream in an intermediate-pressure hydrogen thermosiphon vessel into an intermediate-pressure thermosiphon hydrogen liquid stream and an intermediate-pressure thermosiphon hydrogen vapor stream;

totally vaporizing the intermediate-pressure thermosiphon hydrogen liquid stream in the cold temperature main heat exchanger;

mixing the totally vaporized intermediate-pressure thermosiphon hydrogen liquid stream with the intermediate-pressure thermosiphon hydrogen vapor stream to form a mixed hydrogen vapor stream;

further warming the mixed hydrogen vapor stream in the cold temperature main heat exchanger to form a first cold intermediate-pressure circulation gaseous hydrogen stream, wherein the cold intermediate-pressure circulation gaseous hydrogen stream comprises a temperature of about 38.5K;

mixing the first cold intermediate-pressure circulation gaseous hydrogen stream with a second hydrogen turbo-expander discharge stream to form a second cold intermediate-pressure circulation gaseous hydrogen stream;

warming the second cold intermediate-pressure circulation gaseous hydrogen stream in the intermediate temperature main heat exchanger to form an intermediate temperature intermediate-pressure circulation gaseous hydrogen stream, wherein the intermediate temperature intermediate-pressure circulation gaseous hydrogen stream comprises a temperature of about 80.3K;

further warming the intermediate temperature intermediate-pressure circulation gaseous hydrogen stream in the precooling main heat exchanger to form an intermediate-pressure circulation gaseous hydrogen stream, wherein the intermediate-pressure circulation gaseous hydrogen stream comprises a temperature of about 311K;

expanding a high-pressure first hydrogen turbo-expander feed stream in the first hydrogen turbo-expander to form the lower pressure first hydrogen turbo-expander discharge stream, wherein the first hydrogen turbo-expander and a first hydrogen expander-compressor form a first expander set, wherein the first hydrogen expander-compressor discharges a first hydrogen expander-compressor discharge stream;

further expanding the lower pressure first hydrogen turbo-expander discharge stream in a second hydrogen turbo-expander to form the second hydrogen turbo-expander discharge stream, wherein the second hydrogen turbo-expander discharge stream comprises a pressure of about 805 kPa·G and a temperature of about 38K, and further wherein the second hydrogen turbo-expander and a second hydrogen expander-compressor form a second expander set;

compressing the second split gaseous hydrogen stream in the second hydrogen expander-compressor to form a higher pressure second hydrogen expander-compressor discharge stream;

further compressing the second hydrogen expander-compressor discharge stream in the first hydrogen expander-compressor to form the first hydrogen expander-compressor discharge stream, wherein the first hydrogen expander-compressor discharge stream comprises a pressure in the range of about 3,500 kPa·G to 4,400 kPa·G; and cooling the first hydrogen expander-compressor discharge stream in an expander-compressor discharge cooler to form the high-pressure circulation hydrogen stream, wherein the high-pressure circulation hydrogen stream comprises a temperature of about 313K.

16. The method of claim 15, wherein the first hydrogen expander-compressor is driven by the first hydrogen turbo-expander to form the first expander set, and the second hydrogen expander-compressor is driven by the second hydrogen turbo-expander to form the second expander set.

17. The method of claim 16, wherein the first expander set and the second expander set are arranged in serial connection.

18. The method of claim 16, wherein the first expander set and the second expander set are magnetic bearing type sets.

19. The method of claim 15, wherein the first hydrogen circulation compressor and the second hydrogen circulation compressor are integrated by a common crank shaft to form an integrated hydrogen circulation compressor.

20. The method of claim 15, further comprising a cold temperature coldbox, wherein the cold temperature coldbox comprises a multilayer insulation vacuum, and further wherein the cold temperature coldbox comprises a product liquid hydrogen pressure let-down valve, the liquid hydrogen storage tank pressure control valve, the first circulation liquid hydrogen pressure let-down valve, the low-pressure hydrogen thermosiphon vessel, the second circulation liquid hydrogen pressure let-down valve, the intermediate-pressure hydrogen thermosiphon vessel, the first hydrogen turbo-expander, the second hydrogen turbo-expander, the intermediate temperature main heat exchanger, and the cold temperature main heat exchanger.

* * * * *